US011874051B2

(12) United States Patent
Steere et al.

(10) Patent No.: US 11,874,051 B2
(45) Date of Patent: Jan. 16, 2024

(54) ICE BALL PRESS

(71) Applicant: Courtright Engineering Company, LLC, Tallmadge, OH (US)

(72) Inventors: Brock Steere, Tallmadge, OH (US); Brian Steere, Tallmadge, OH (US); Mark Stahl, Tallmadge, OH (US)

(73) Assignee: COURTRIGHT ENGINEERING COMPANY, LLC, Tallmadge, OH (US)

( * ) Notice: Subject to any disclaimer, the term of this patent is extended or adjusted under 35 U.S.C. 154(b) by 0 days.

(21) Appl. No.: 17/672,683

(22) Filed: Feb. 15, 2022

(65) Prior Publication Data

US 2022/0260298 A1 Aug. 18, 2022

Related U.S. Application Data

(60) Provisional application No. 63/149,513, filed on Feb. 15, 2021.

(51) Int. Cl.
*F25C 5/14* (2006.01)

(52) U.S. Cl.
CPC ..... *F25C 5/14* (2013.01)

(58) Field of Classification Search
CPC ..... F25C 5/14
USPC ..... 62/371
See application file for complete search history.

(56) References Cited

U.S. PATENT DOCUMENTS 508,198 A * 11/1893 Abbott ..... F25D 7/00 426/418
1,060,973 A * 5/1913 Edman ..... A47B 31/02 312/236
3,721,103 A * 3/1973 Brandt ..... F25C 1/04 62/73
6,561,787 B2 * 5/2003 Sun ..... B65D 65/466 425/410
8,882,489 B1 * 11/2014 Coomer ..... F25C 5/14 425/408

(Continued)

FOREIGN PATENT DOCUMENTS

CN 204574657 U * 8/2015
CN 206724537 U * 12/2017

(Continued)

OTHER PUBLICATIONS

DE 202016007935 U1, machine translation (Year: 2023).*

*Primary Examiner* — Eric S Ruppert
*Assistant Examiner* — Kirstin U Oswald
(74) *Attorney, Agent, or Firm* — Cooper Legal Group LLC

(57) ABSTRACT

An ice-shaping device includes a base having an inside surface and an outside surface. The inside surface defines a first ice molding cavity while the outside surface defines a channel. The ice-shaping device includes a cover having an inside surface and an outside surface. The inside surface defines a second ice molding cavity that cooperates with the first ice molding cavity. The cover includes a protrusion on the inside surface that cooperates with the channel. The cover is movable with respect to the base. When in a closed position, the base is located within an interior space of the cover defined by the inside surface of the cover. As the cover is moved from an open position to the closed position, the protrusion cooperates with the channel providing a physical interference to inhibit rotation of the cover with respect to the base.

20 Claims, 18 Drawing Sheets

(56) References Cited

U.S. PATENT DOCUMENTS

| | | | | |
|---|---|---|---|---|
| 10,746,453 | B2 * | 8/2020 | Tarr | F25C 5/08 |
| 2004/0206250 | A1 * | 10/2004 | Kondou | F25C 5/14<br>99/426 |
| 2014/0165610 | A1 * | 6/2014 | Boarman | F25C 1/00<br>62/3.63 |
| 2014/0165619 | A1 * | 6/2014 | Culley | F25C 5/08<br>62/344 |
| 2014/0167321 | A1 * | 6/2014 | Culley | F25C 1/04<br>264/319 |
| 2014/0238068 | A1 * | 8/2014 | Villalobos | F25C 1/22<br>62/340 |
| 2015/0367536 | A1 * | 12/2015 | Compton | F25C 1/22<br>425/395 |
| 2019/0264970 | A1 * | 8/2019 | Tarr | F25C 5/08 |
| 2019/0353415 | A1 * | 11/2019 | Henderson | F25C 5/14 |
| 2020/0011582 | A1 * | 1/2020 | Coomer | F25C 5/14 |
| 2020/0041186 | A1 * | 2/2020 | Junge | F25C 1/12 |
| 2020/0400359 | A1 * | 12/2020 | Junge | F25C 5/08 |

FOREIGN PATENT DOCUMENTS

| | | | | | |
|---|---|---|---|---|---|
| CN | 111947365 | A | * | 11/2020 | |
| CN | 212746994 | U | * | 3/2021 | |
| DE | 202016007935 | A | * | 1/2017 | |
| EP | 2645021 | A2 | * | 10/2013 | F25C 1/04 |
| JP | 2003121038 | A | * | 4/2003 | F25C 5/14 |
| JP | 2004183929 | A | * | 7/2004 | |
| KR | 101643635 | B1 | * | 7/2016 | |

* cited by examiner

ICE BALL PRESS

CROSS REFERENCE TO RELATED APPLICATIONS

This application claims priority to U.S. Provisional Patent Application No. 63/149,513, filed on Feb. 15, 2021, entitled "ICE BALL PRESS," which is hereby incorporated by reference herein.

TECHNICAL FIELD

The instant application is generally directed towards an ice press. For example, the instant application is directed towards an ice press that creates a spherical ice ball.

BACKGROUND

Ice presses may be used for creating spherical ice balls from ice blocks of various shapes in order to reduce a surface area to volume ratio of the ice prior to chilling a liquid. The reduced surface area to volume ratio reduces the amount of melted water that may dilute the liquid.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

According to some embodiments, an ice-shaping device includes a base extending from a first base end to a second base end. The base has a base inside surface and a base outside surface. The base inside surface defines a first ice molding cavity at the first base end while the base outside surface defines a channel that extends away from the first base end toward the second base end. The ice-shaping device also includes a cover extending from a first cover end to a second cover end. The cover includes a cover inside surface and a cover outside surface. The cover inside surface defines a second ice molding cavity that cooperates with the first ice molding cavity. The cover includes a protrusion on the cover inside surface that cooperates with the channel. The cover is movable with respect to the base from an open position to a closed position. When in the closed position, the first base end is located within an interior space of the cover defined by the cover inside surface and the second ice molding cavity cooperates with the first ice molding cavity. When in the open position, the first base end is not located within the interior space of the cover. As the cover is moved from the open position to the closed position, the protrusion cooperates with the channel providing a physical interference to inhibit rotation of the cover with respect to the base.

According to some embodiments, an ice-shaping device includes a base extending from a first base end to a second base end. The base has a base inside surface and a base outside surface, the base inside surface defines a first ice molding cavity at the first base end. The base includes a protrusion on the base outside surface. The ice-shaping device also includes a cover extending from a first cover end to a second cover end. The cover has a cover inside surface and a cover outside surface, the cover inside surface defines a second ice molding cavity that cooperates with the first ice molding cavity. The cover inside surface defines a channel that cooperates with the protrusion. The cover is movable with respect to the base from an open position to a closed position. When in the closed position, the first base end is located within an interior space of the cover defined by the cover inside surface and the second ice molding cavity cooperates with the first ice molding cavity. When in the open position, the first base end is not located within the interior space of the cover. As the cover is moved from the open position to the closed position, the protrusion cooperates with the channel providing a physical interference to inhibit rotation of the cover with respect to the base.

According to some embodiments, an ice-shaping device includes a base extending from a first base end to a second base end, the base having a base inside surface and a base outside surface. The base inside surface defines a first ice molding cavity at the first base end. The base includes a first tab and a second tab at the first base end with a relief area defined between the first tab and the second tab. The ice-shaping device also includes a cover extending from a first cover end to a second cover end, the cover having a cover inside surface and a cover outside surface. The cover inside surface defines a second ice molding cavity that cooperates with the first ice molding cavity. The cover is movable with respect to the base from an open position to a closed position. When in the closed position, the first tab, the second tab, and the relief area are located within an interior space of the cover defined by the cover inside surface and the second ice molding cavity cooperates with the first ice molding cavity such that melted water from at least one of the first ice molding cavity or the second ice molding cavity is directed through the relief area. When in the open position, the first tab, the second tab, and the relief area are not located within the interior space of the cover.

The following description and annexed drawings set forth certain illustrative aspects and implementations. These are indicative of but a few of the various ways in which one or more aspects may be employed. Other aspects, advantages, and/or novel features of the disclosure will become apparent from the following detailed description when considered in conjunction with the annexed drawings. It is worthy of note that all of the dimensions shown in the annexed drawings are examples and are not meant to be limiting.

DETAILED DESCRIPTION

Figure 1:
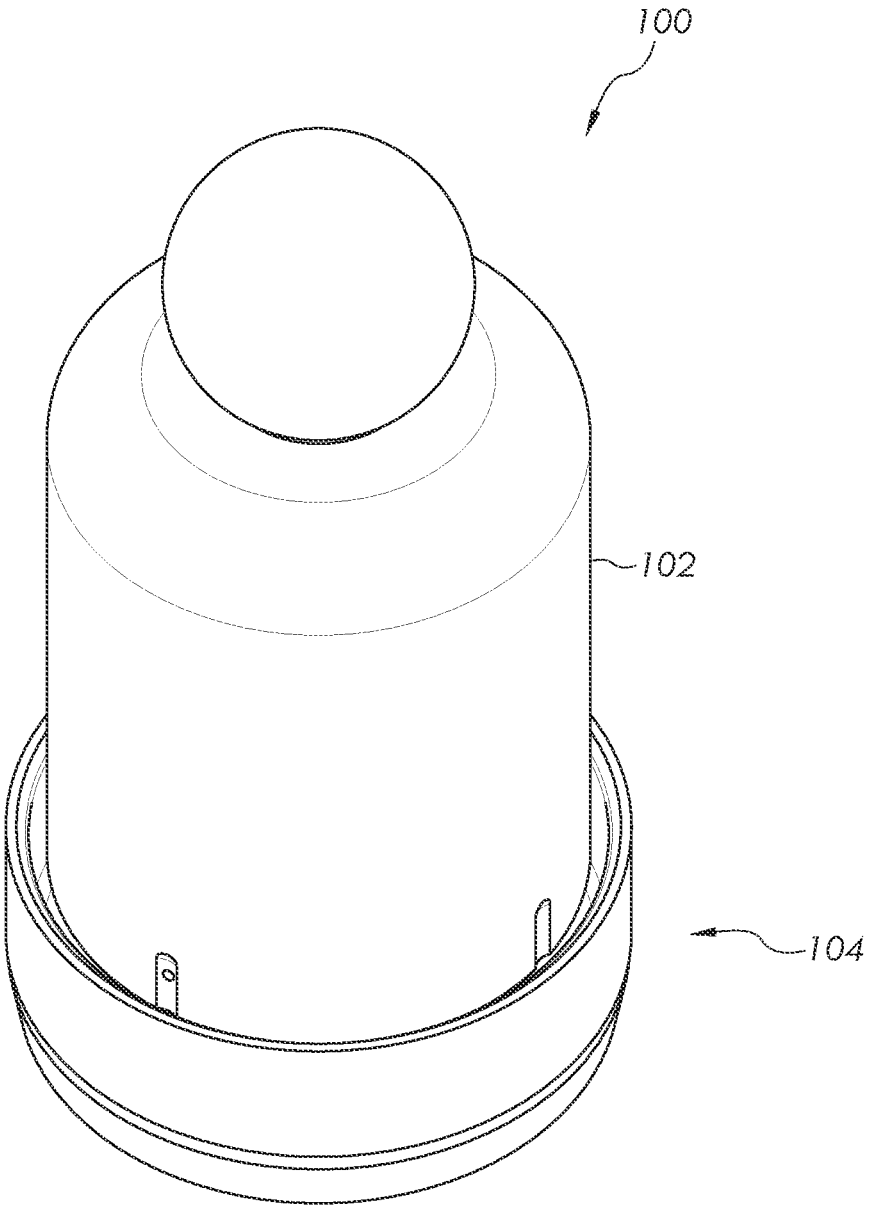
FIG. 1 illustrates a perspective view of an ice-shaping device according to at least one embodiment of the disclosure.

The claimed subject matter is now described with reference to the drawings, wherein like reference numerals are used to refer to like elements throughout. In the following description, for purposes of explanation, numerous specific details are set forth in order to provide an understanding of the claimed subject matter. It is evident, however, that the claimed subject matter may be practiced without these specific details. In other instances, structures and devices are illustrated in block diagram form in order to facilitate describing the claimed subject matter. Relative size, orientation, etc. of parts, components, etc. may differ from that which is illustrated while not falling outside of the scope of the claimed subject matter. The present disclosure uses the terms shaping and molding (and their variants) interchangeably.

Referring to FIG. 1, a perspective view of an ice-shaping device 100 is illustrated. In some examples, ice-shaping devices can be known as ice ball presses, and this disclosure will use the terms ice-shaping device and ice ball press interchangeably. As shown, the ice-shaping device 100 includes a cover 102 (which can also be termed a top press portion) and a base 104. The cover 102 is movable with respect to the base 104 from an open position to a closed position. When in the closed position, a portion of the base 104 can be located within an interior space of the cover 102, and the cover 102 and the base 104 can cooperate to define a volume in which an ice form is molded into a desired shape, such as a sphere or a spherical ice mass. Of course, other shapes are contemplated in conjunction with the present disclosure, although ice spheres may have particular desired benefits.

Figure 2:
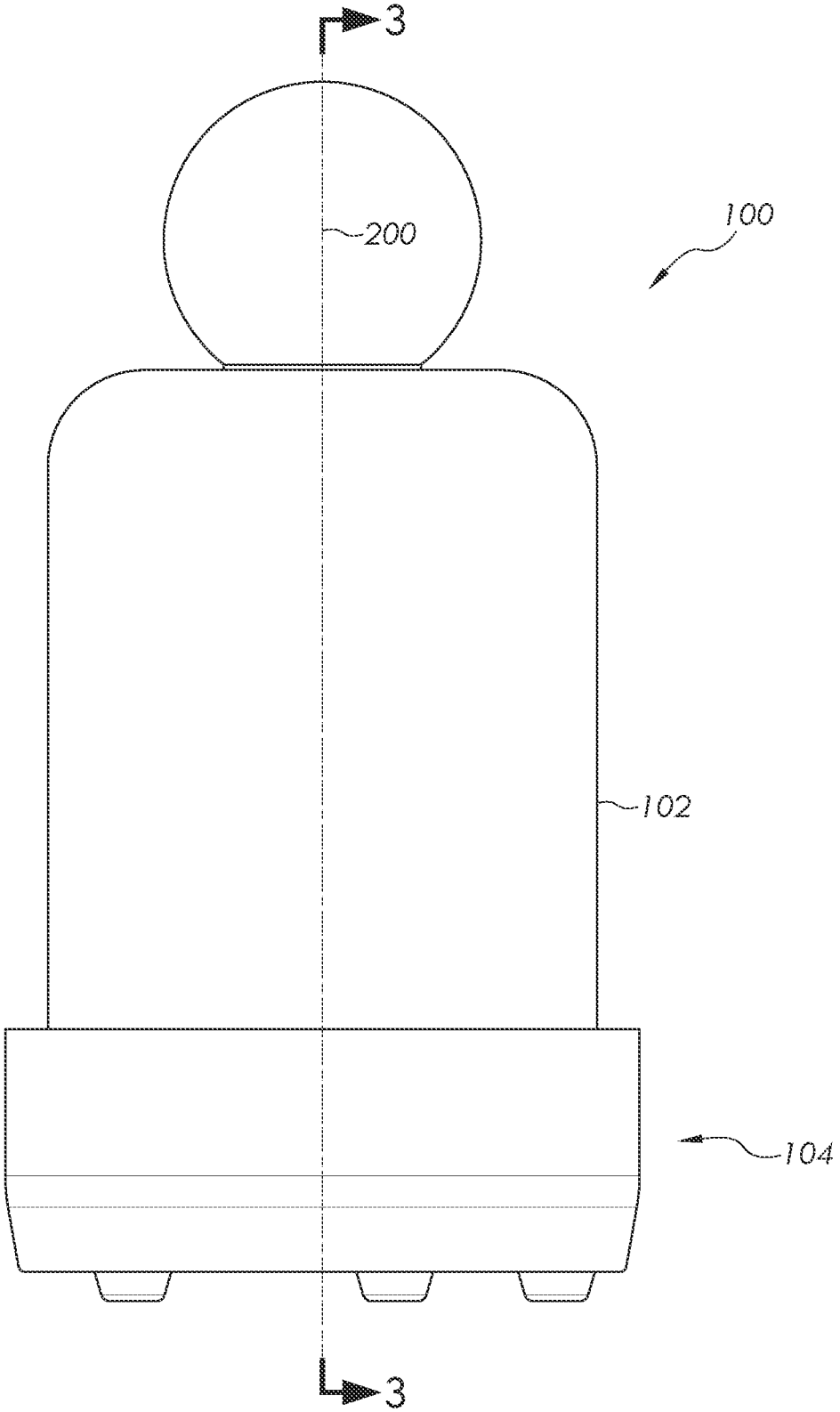
FIG. 2 illustrates an elevation view of the ice-shaping device of FIG. 1.

Referring to FIG. 2, an elevation view of the ice-shaping device 100 is illustrated. As shown, the cover 102 and the base 104 can include some portions that are cylindrical, and these portions can be centered about an axis 200. It is to be appreciated that the exterior dimensions and shapes of the cover 102 and the base 104 can be selected for aesthetic benefits or operational benefits as the designer or end user may desire. In some examples, logos, trademarks, or other designs may be placed on the exterior surfaces of the ice-shaping device 100.

Figure 3:
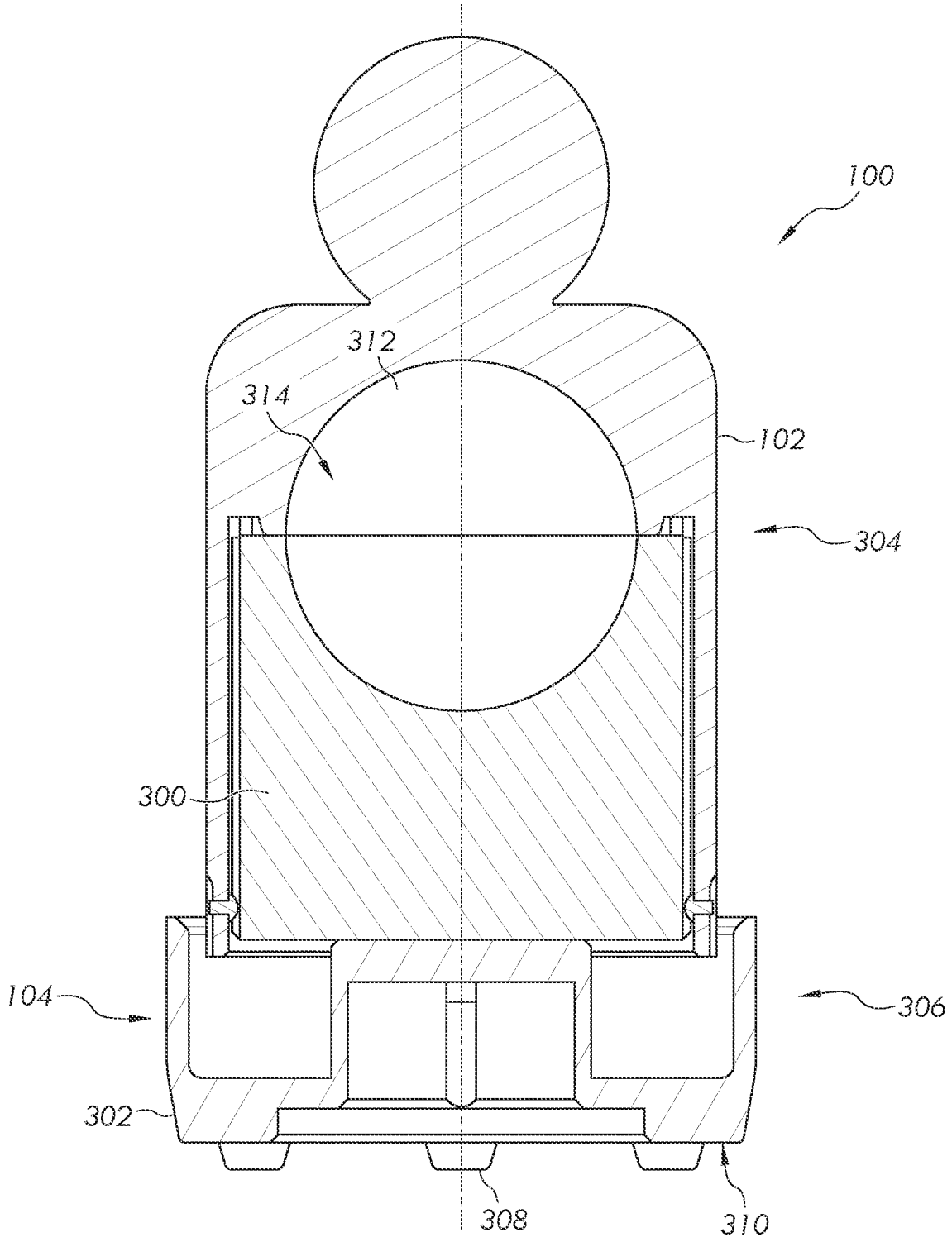
FIG. 3 illustrates a cross-section view of the ice-shaping device taken along line 3-3 of FIG. 2.

Referring to FIG. 3, a cross-section view of the ice-shaping device 100 is illustrated with the cover being in the closed position. In some examples, the base 104 can be composed of two or more pieces. The base 104 of the example ice-shaping device 100 shown in FIG. 3 includes a bottom press 300 and a drain base 302. The bottom press 300 and the drain base 302 can be attached to one another by any suitable method or structure including, but not limited to, a threaded fastener, press-fit, welding, etc. It is to be appreciated that the base 104 can be constructed of a single, unitary piece, however, there may be manufacturing advantages and cost advantages attained by constructing the base 104 of more than one piece (e.g., one bottom press 300 and one drain base 302). In some examples, the base 104 includes a leg 308. The leg 308 can maintain a bottom surface 310 at a distance away from a surface (e.g., a bar top, counter top, etc.). Any suitable number of legs 308 can be included.

The base 104 extends from a first base end 304 to a second base end 306. In some examples, the first base end 304 can be located on the bottom press 300 while the second base end 306 is located at or toward the drain base 302. Other orientations are also contemplated. The assembly of the cover 102 and the base 104 will be further discussed below after discussion of the individual parts that together compose the ice-shaping device 100.

Figure 4:
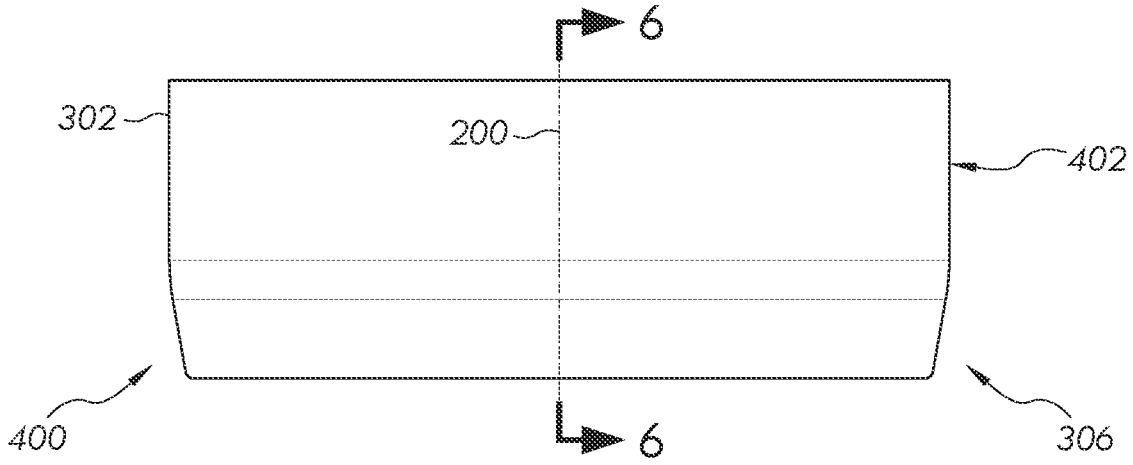
FIG. 4 illustrates an elevation view of a base of the ice-shaping device of FIG. 1.

Referring to FIG. 4, an elevation view of the drain base 302 of the base 104 of the ice-shaping device 100 is illustrated. The drain base 302 can be constructed of a metal or an alloy containing a metal. In some examples, it may be advantageous to construct the drain base 302 of a metal or a metal alloy having material properties beneficial to molding ice. For example, if portions of the ice-shaping device 100 are constructed of metals having a relatively high coefficient of thermal conductivity, heat transfer between the ice within the ice-shaping device 100 and the ice-shaping device 100 can occur more rapidly in order to form the ice to a desired shape within a shorter period of time. In some examples, the drain base 302 is constructed of aluminum or copper, however, any suitable material is acceptable with the present disclosure. In some examples, the drain base 302 is machined from a single piece of metal or metal alloy. Of course, other processes including molding the drain base 302 as a single, unitary piece can also be used with the present disclosure.

In some examples, the drain base 302 has an outside surface 402 that is cylindrical in shape, and the generally cylindrical drain base 302 can be centered about the axis 200. Of course, other exterior shapes, profiles, and cross-sections for the drain base 302 can be used, and the cylindrical shape is not meant to be limiting. As shown, the drain base 302 can include a taper 400 at a lower portion of the drain base 302 for aesthetic purposes, or weight removal purposes, etc. As noted previously, the drain base 302 can be located at or toward the second base end 306 of the base 104.

Figure 5:
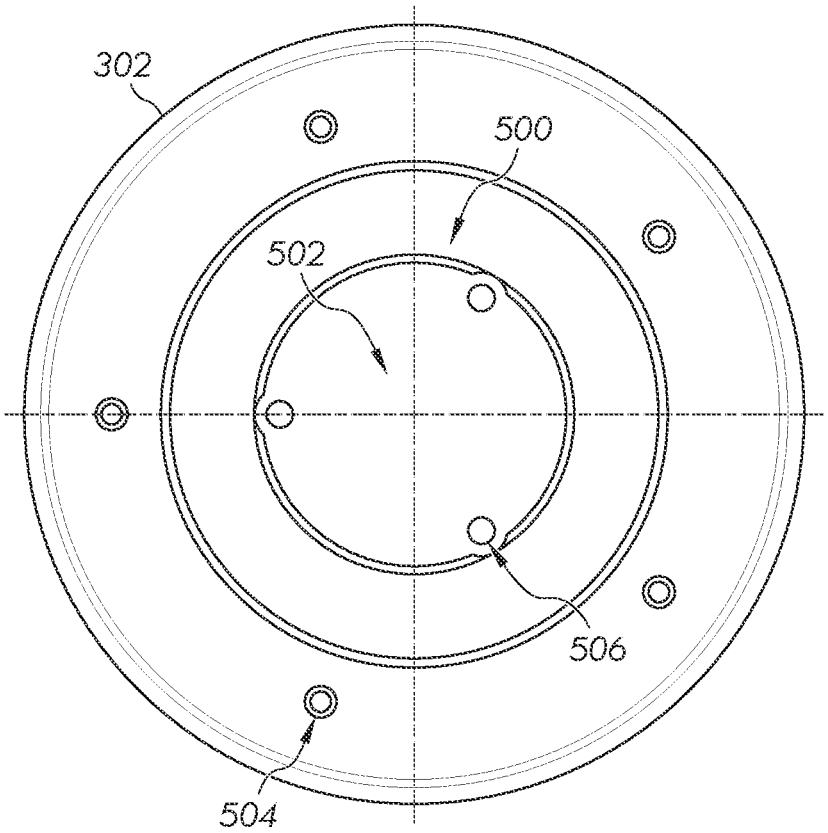
FIG. 5 illustrates a bottom view of the base.

Referring to FIG. 5, a bottom view of the drain base 302 is illustrated. In some examples, the drain base 302 can define a shallow, cylindrical hollow area 500 centered within the drain base 302 and extending upward from a bottom surface of the drain base 302. The drain base 302 can also define a deeper, cylindrical hollow area 502 centered within the drain base 302 and extending upward from the bottom surface of the drain base 302. These hollow areas 500, 502 of the drain base 302 can be defined for aesthetic purposes, weight removal purposes, or preferred design engineering of fastening hardware used to secure or attach the drain base 302 to the bottom press 300 (not shown in FIG. 5), etc. The drain base 302 can define blind holes or apertures 504 to attach the previously described legs 308 (not shown in FIG. 5). The apertures 504 can be threaded in order to mount the legs 308, however, any attachment means or structure is acceptable. The drain base 302 can also define apertures 506 that can be used to attach the drain base 302 to the bottom press 300 (not shown in FIG. 5), for example, with threaded fasteners.

Figure 6:
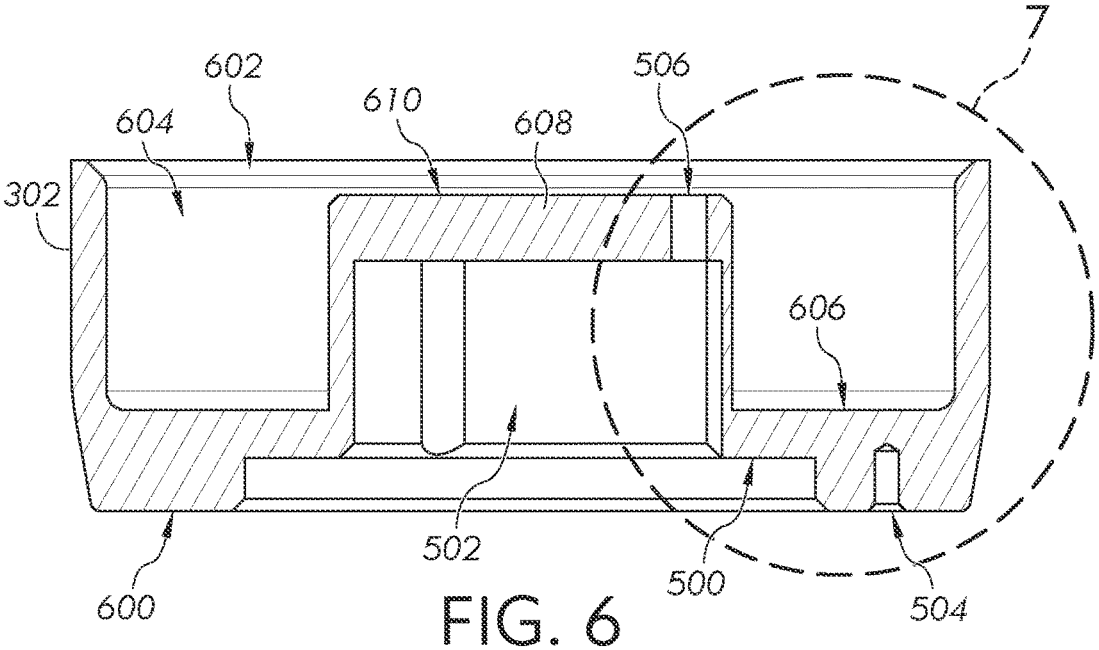
FIG. 6 illustrates a cross-section view of the base taken along line 6-6 of FIG. 4.

Referring to FIG. 6, a cross-section view of the base taken along line 6-6 of FIG. 4 is illustrated. This cross-section view illustrates an example depth relationship between the relatively shallow hollow area 500 and the deeper hollow area 502 that extend generally upward from the bottom surface 600 of the drain base 302. Additionally, example depths of apertures 504 and apertures 506 are shown. In some examples, the drain base 302 can define a relief extending generally downward from a top surface 602 of the drain base 302.

The drain base 302 defines a retaining volume 604 in order to retain a quantity of melted water from at least one portion of an ice molding cavity that will be described below. As shown, the retaining volume 604 can be of annular shape, however, any suitable shape or cross-section can be used with the devices of the present disclosure. The retaining volume 604 can be at least partially defined by a bottom surface 606 that is separated a distance from the bottom surface 600 of the drain base 302.

The drain base 302 can include a raised table 608 extending generally away from the bottom surface 606 of the retaining volume 604. The raised table 608 can include an upward facing surface 610 that cooperates with a surface of the bottom press 300 (not shown in (FIG. 6) for mounting purposes.

Figure 7:
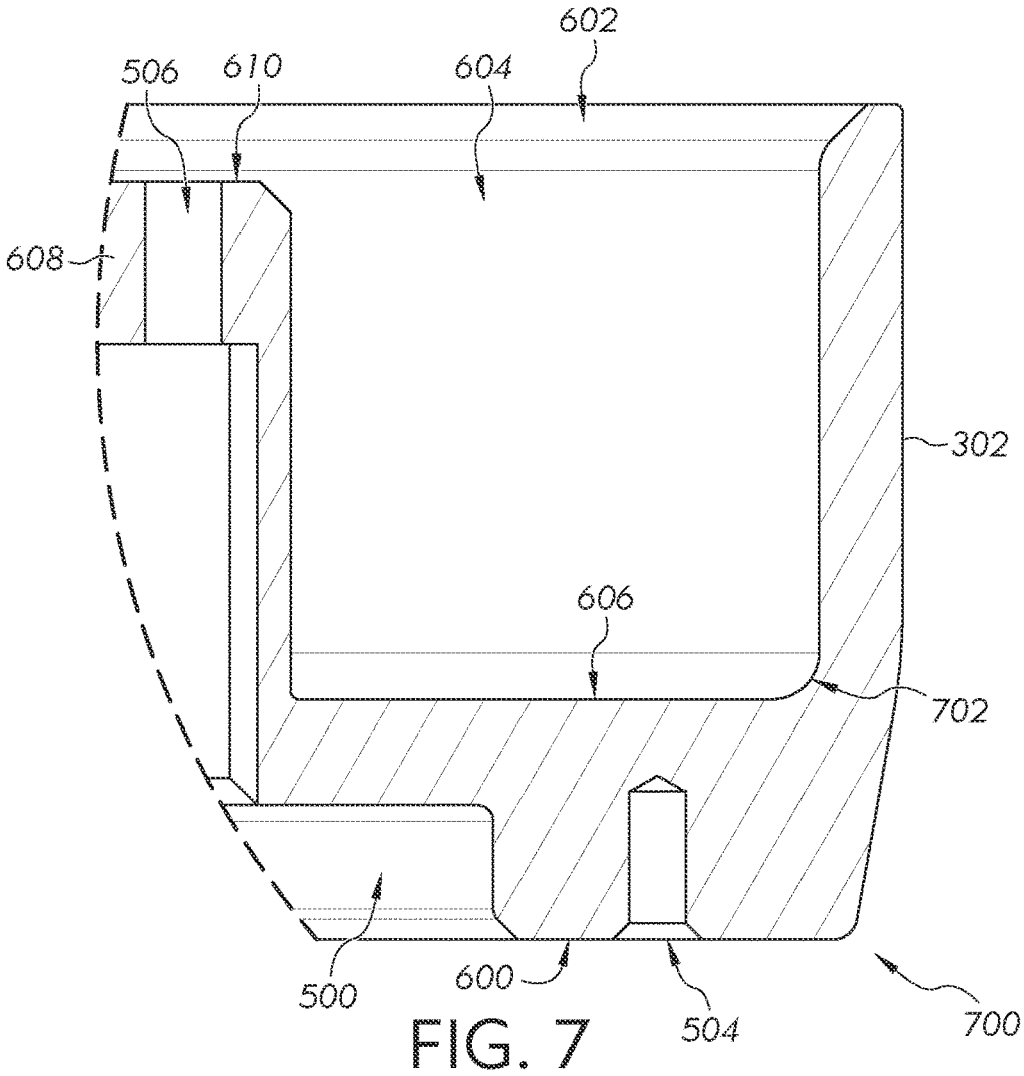
FIG. 7 illustrates a detail view of FIG. 6.

Referring to FIG. 7, a detail view of circled area 7 of FIG. 6 is illustrated to detail an example cross-section geometry defining the retaining volume 604. As shown, machining processes as previously described can be included to create a radius 700 at the bottom surface 600 where the bottom surface 600 meets a side of the drain base 302. Additionally, a radius can be located at the bottom surface 606 defining the retaining volume 604. A radius can also be located at the top of the side walls defining the retaining volume 604. Various other chamfers and radii can be included as shown in FIG. 7 to ease cooperation of various parts, ease machining requirements, remove relatively sharp corners for ease of handling, etc.

Figure 8:
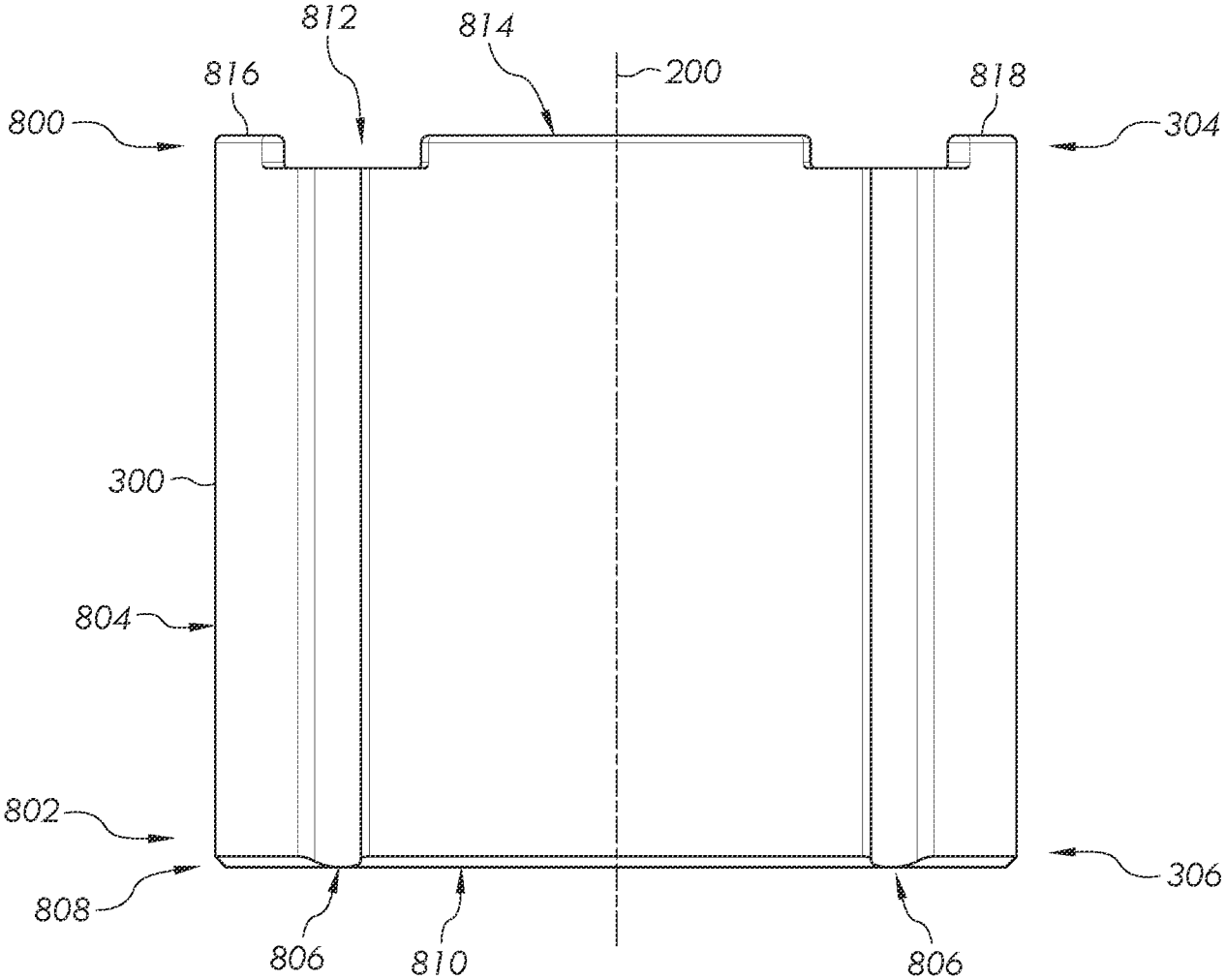
FIG. 8 illustrates an elevation view of a bottom press portion of the ice-shaping device of FIG. 1.

Referring to FIG. 8, an elevation view of the bottom press 300 (or central portion of the base 302) of the ice-shaping device 100 is illustrated. The bottom press 300 can extend from an upper end 800 to a lower end 802. In some examples, the upper end 800 and the lower end 802 can correspond to the first base end 304 and the second base end 306, respectively, of the base 104. In some examples, the bottom press 300 has a base outside surface 804 that is cylindrical in shape, and the generally cylindrical bottom press 300 can be centered about the axis 200. Of course, other exterior shapes, profiles, and cross-sections for the bottom press 300 can be used, and the cylindrical shape is not meant to be limiting. The base outside surface 804 defines a channel 806 that extends away from the first base end 304 toward the second base end 306. The channel 806 can provide a pathway or direct a quantity of melted water from at least one portion of an ice molding cavity (described below) to the retaining volume 604 defined by the drain base 302 shown in FIG. 6. Any suitable quantity of channels 806 can be defined by the bottom press 300.

As shown, the bottom press 300 can include a chamfer 808 at a lower portion of the bottom press 300. The bottom press 300 can have a bottom surface 810 configured to mount to the upward facing surface 610 of the drain base 302 shown in FIG. 6 and FIG. 7. The bottom press 300 can also define a relief area 812 on a top surface 814 at the first base end 304. The relief area 812 is in fluid communication with the channel 806 and at least one portion of an ice molding cavity (described below) to direct melted water from at the ice molding cavity to the channel 806.

The bottom press 300 can include a first tab 816 and a second tab 818 at the first base end 304 with the relief area 812 at least partially defined between the first tab 816 and the second tab 818. Additionally, the first tab 816 and the second tab 818 can cooperate with a space defined by the cover 102 which will be described below. Any suitable quantity of tabs 816, 818 can be included at the first base end 304.

The bottom press 300 (or central portion of the base 104) can be constructed of a metal or an alloy containing a metal. In some examples, it may be advantageous to construct the bottom press 300 of a metal or a metal alloy having material properties beneficial to molding ice. For example, if portions of the ice-shaping device 100 are constructed of metals having a relatively high coefficient of thermal conductivity, heat transfer between the ice and the ice-shaping device 100 can occur more rapidly in order to form the ice to a desired shape within a shorter period of time. In some examples, the bottom press 300 is constructed of aluminum or copper, however, any suitable material is acceptable with the present disclosure. In some examples, the bottom press 300 is machined from a single piece of metal or metal alloy. Of course, other processes including molding or die casting the bottom press 300 as a single, unitary piece can also be used with the present disclosure.

Figure 9:
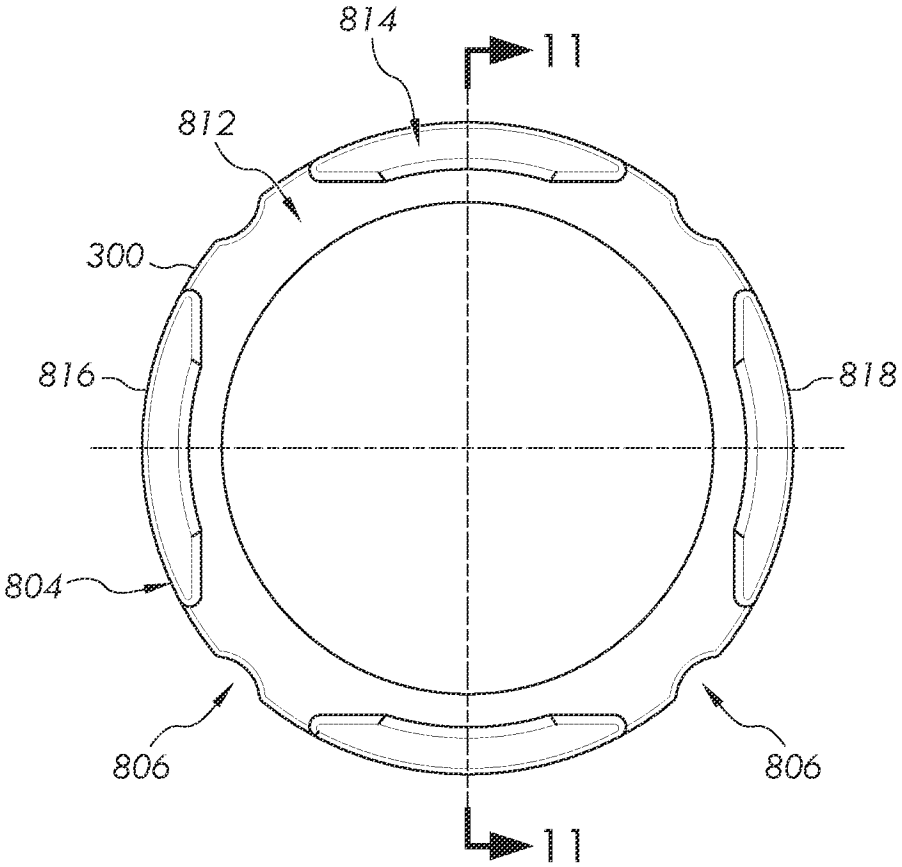
FIG. 9 illustrates a top view of the bottom press portion.

Referring to FIG. 9, a top view of the bottom press 300 is illustrated. An example geometry of the first tab 816 and the second tab 818 are shown, however, any suitable geometry is acceptable for use with the present disclosure. Spacing between the tabs 816, 818 can be designed and manufactured to optimize the movement of ice melt (water) flow from the relief area 812 to the channels 806. Additionally, four channels 806 are shown, but this is merely an example, and is not meant to be limiting. In some examples, the channel 806 also provides open space for cooperation with a protrusion (not shown in FIG. 9) located on the cover 102.

Figure 10:
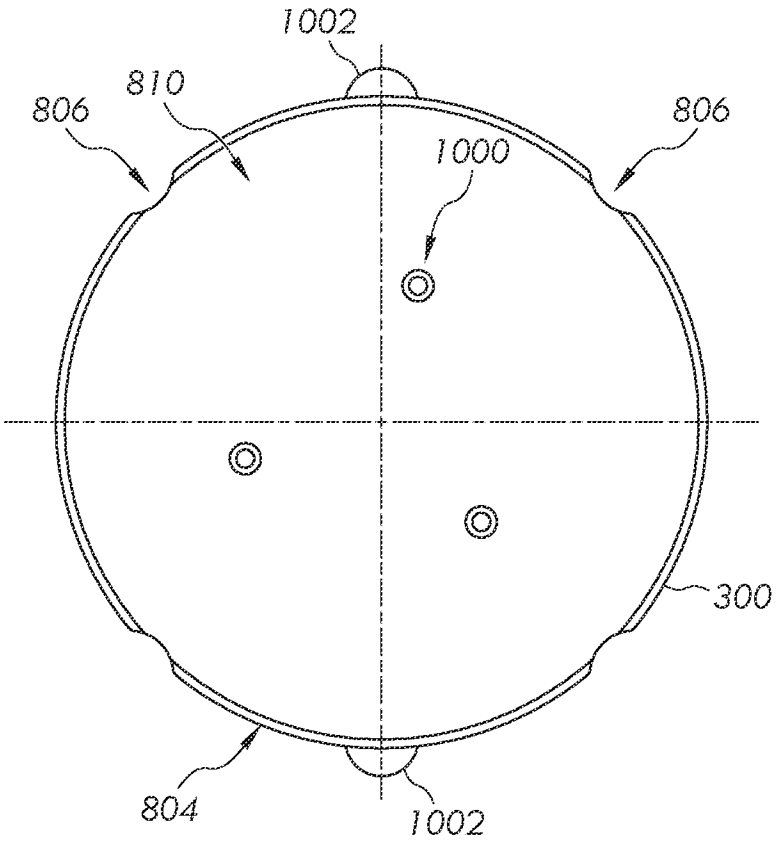
FIG. 10 illustrates a bottom view of the bottom press portion.

Referring to FIG. 10, a bottom view of the bottom press 300 is illustrated. The bottom press 300 can define apertures 1000 that can be used to attach the bottom press 300 to the drain base 302 (not shown in FIG. 10), for example, with threaded fasteners. In some examples, the bottom surface 810 of the bottom press 300 can be in contact with the upward facing surface 610 of the drain base 302 when the bottom press 300 and the drain base 302 are attached to one another.

In some examples, the bottom press 300 can include a protrusion 1002 on the base outside surface 804. The protrusion 1002 can cooperate with an open space or volume (e.g., a slot or groove) defined by the cover 102 to prevent rotation of the cover 102 relative to the base 104.

Figure 11:
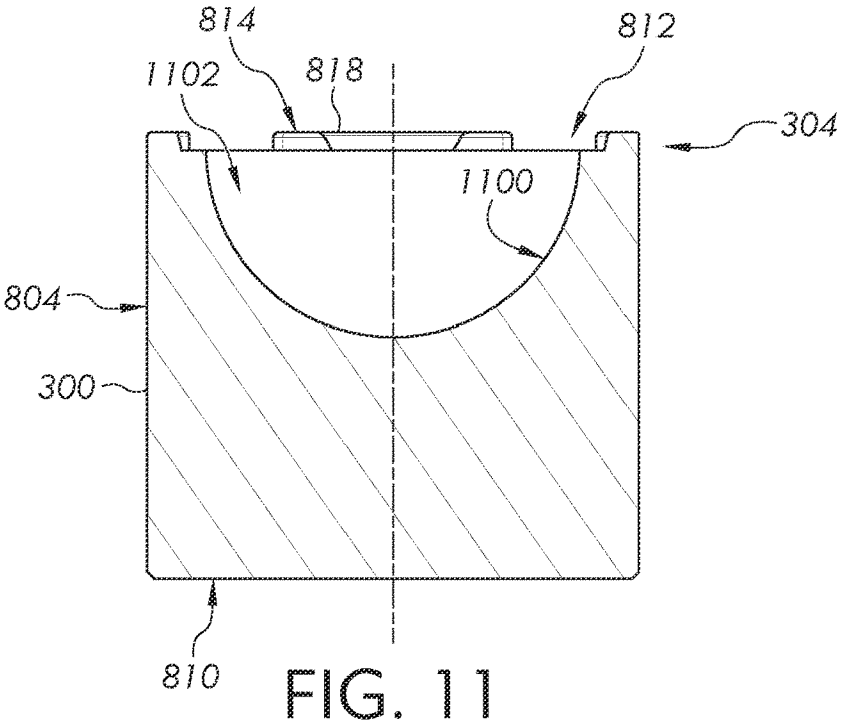
FIG. 11 illustrates a cross-section view of the bottom press portion taken along line 11-11 of FIG. 9.

Referring to FIG. 11, a cross-section view of the bottom press 300 taken along line 11-11 of FIG. 9 is illustrated. The bottom press 300 of the base 104 also includes a base inside surface 1100 in addition to the base outside surface 804. The base inside surface 1100 defines a first ice molding cavity 1102 at the first base end 304. In some examples, the base inside surface 1100 is hemispherical to define the first ice molding cavity 1102. The hemispherical inside surface 1100 is one example of possible shapes or profiles of the base inside surface 1100, and other shapes or profiles are also contemplated.

It is worthy of note that the first ice molding cavity 1102 is in fluid communication with the relief area 812 which is, in turn, in fluid communication with the channel 806, which is in fluid communication with the retaining volume 604 of the drain base 302 to direct the quantity of melted water from the first ice molding cavity 1102 to the retaining volume 604.

Figure 12:
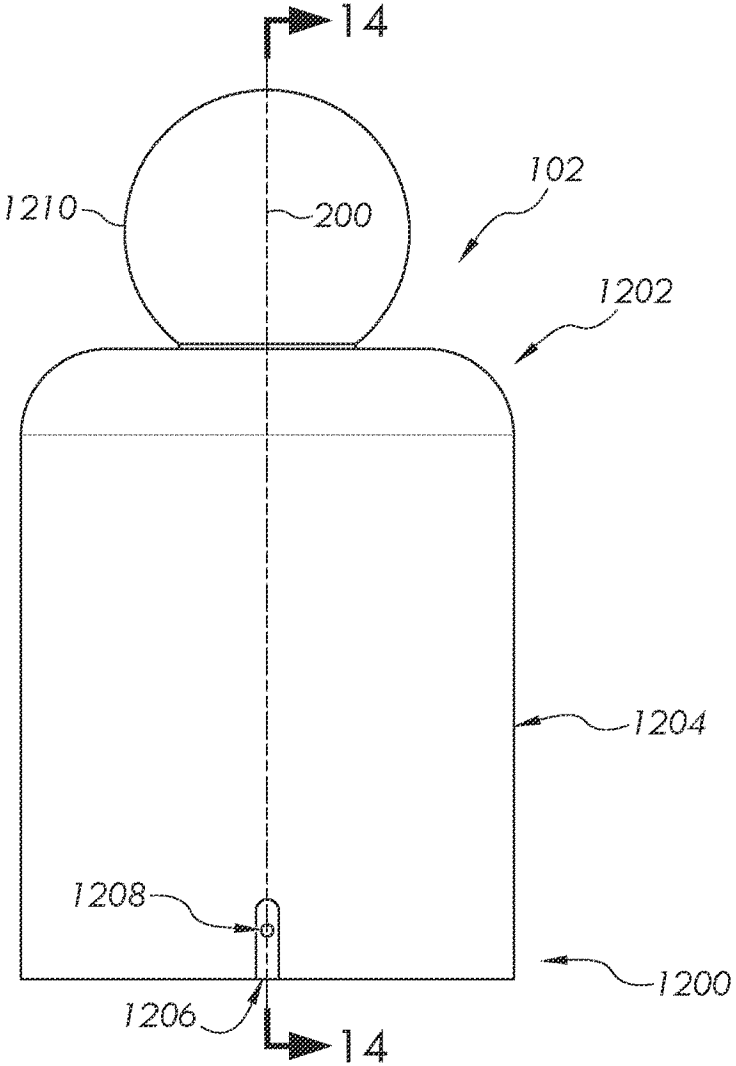
FIG. 12 illustrates an elevation view of a top press portion or cover of the ice-shaping device of FIG. 1.

Referring to FIG. 12, an elevation view of a top press portion or cover 102 of the ice-shaping device 100 is illustrated. The cover 102 extends from a first cover end 1200 to a second cover end 1202. The cover 102 has a cover outside surface 1204 that can be cylindrical in shape and the cylindrical shape of the cover 102 can be centered about axis 200.

The cover 102 can be constructed of a metal or an alloy containing a metal. In some examples, it may be advantageous to construct the cover 102 of a metal or a metal alloy having material properties beneficial to molding ice. For example, if portions of the ice-shaping device 100 are constructed of metals having a relatively high coefficient of thermal conductivity, heat transfer between the ice and the ice-shaping device 100 can occur more rapidly in order to form the ice to a desired shape within a shorter period of time. Additionally, if the cover 102 is constructed of a relatively dense material, the added weight of the cover 102 can also foster formation of the ice to a desired shape within a shorter period of time, as a surface of the cover 102 will directly impinge on the ice, placing a significant percentage of the weight of the cover 102 directly upon the ice. In some examples, the cover 102 is constructed of aluminum or copper, however, any suitable material is acceptable with the present disclosure. In some examples, the cover 102 is machined from a single piece of metal or metal alloy. Of course, other processes including molding or die casting the cover 102 as a single, unitary piece can also be used with the present disclosure.

As shown, the cover 102 can define a slot, groove, or channel 1206 within the outside surface 1204. The cover 102 can also define an aperture 1208 that aligns with the channel 1206 such that a protrusion can be attached to the cover 102. The protrusion will be further discussed below.

In some examples, the cover 102 includes a handle 1210 on the cover outside surface 1204 or a top side of the cover 102. The handle 1210 can be generally spherical, however, any suitable shape of handle 1210 can be used with the devices of the present disclosure.

Figure 13:
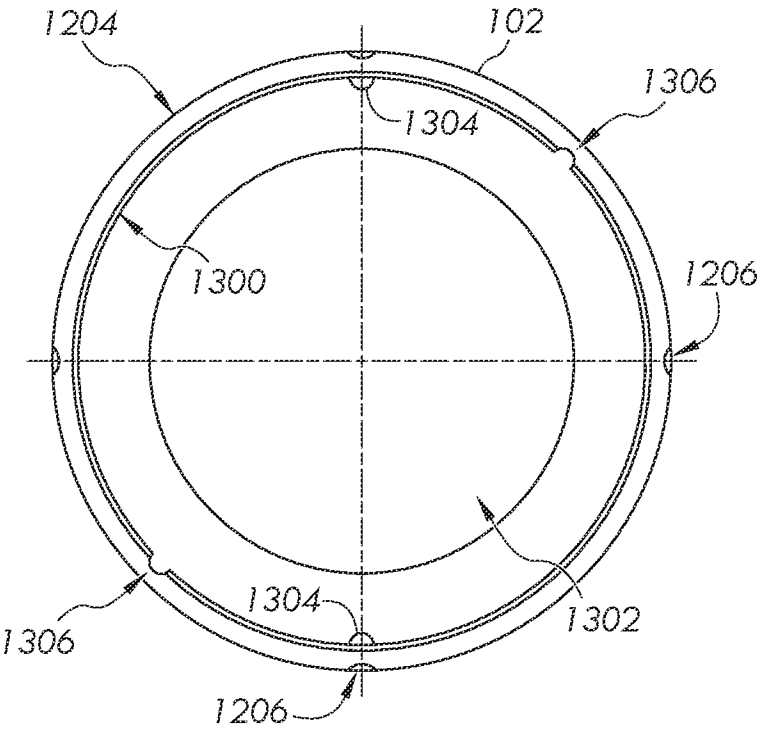
FIG. 13 illustrates a bottom view of the top press portion.

Referring to FIG. 13, a bottom view of the top press portion, or cover 102, is illustrated. The cover 102 includes a cover inside surface 1300 that is cylindrical in shape and can be centered about the axis 200. The cover inside surface 1300 at least partially defines an interior space 1302 that is also generally cylindrical in shape and can be centered about the axis 200 (going into and out of FIG. 13 at the intersection of the center lines). In some examples, the cylindrical shape of the cover inside surface 1300 promotes cooperation with the cylindrical-shaped base outside surface 804 (shown in FIG. 8).

Figure 14:
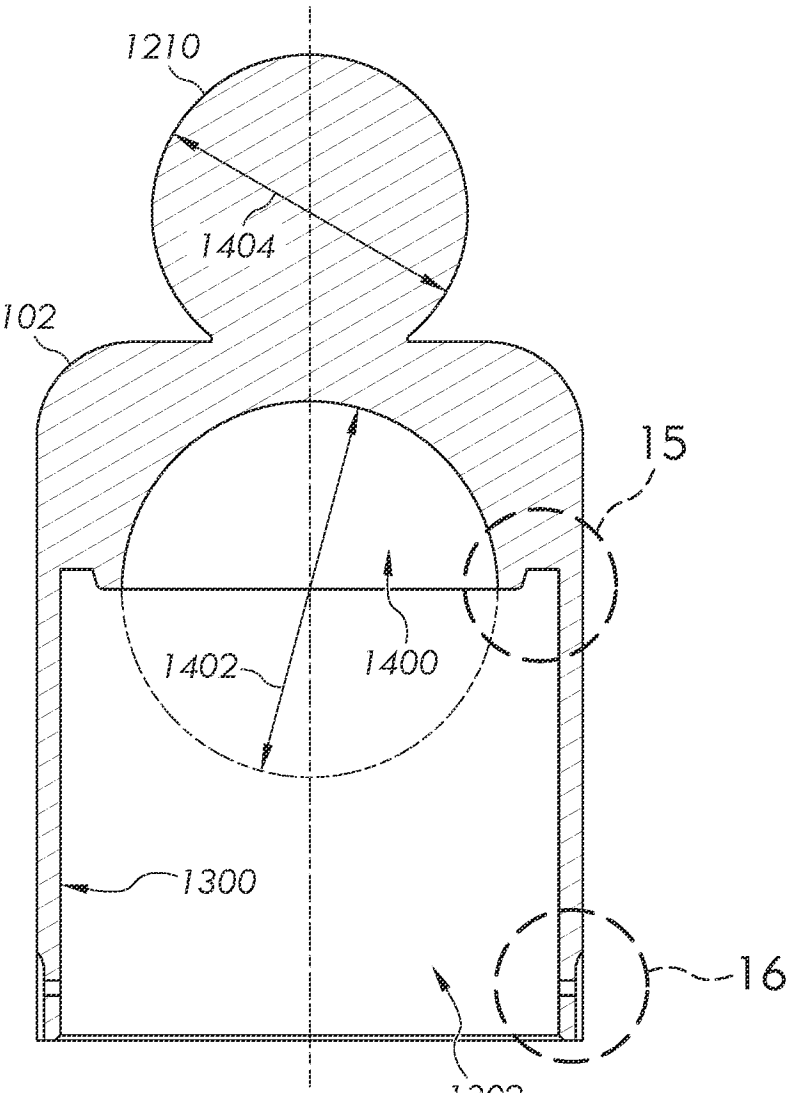
FIG. 14 illustrates a cross-section view of the top press portion taken along line 14-14 of FIG. 12.

In some examples, the cover 102 can include a protrusion 1304 located on the cover inside surface 1300. The protrusion 1304 can be a threaded fastener attached to the cover 102 through the aperture 1208 at the channel 1206. However, any suitable protrusion is satisfactory, and the threaded fastener example is not meant to be limiting. The protrusion 1304 cooperates with the channel 806 of the bottom press 300 (shown in FIG. 8). As previously mentioned, the cover 102 is movable with respect to the base 104 from an open position as shown in FIGS. 1-3 to a closed position as shown in FIGS. 8, 11, and 14. The protrusion 1304 cooperates with the channel 806 defined by the bottom press 300 to prevent rotation of the cover 102 relative to the base 104 while the cover 102 is moving with respect to the base 104.

In some examples, the cover inside surface 1300 defines a channel 1306 that cooperates with the protrusion 1002 of the bottom press 300 (shown in FIG. 10). Any suitable protrusion is satisfactory for use with the present disclosure. Similar to the previously described protrusion and channel cooperation, the protrusion 1002 cooperates with the channel 1306 of the cover 102. As previously mentioned, the cover 102 is movable with respect to the base 104 from an open position to a closed position, and the protrusion 1002 cooperates with the channel 1306 defined by the cover 102 to prevent rotation of the cover 102 relative to the base 104 while the cover 102 is moving with respect to the base 104. The protrusion and channel combination of the present paragraph may eliminate the need for the protrusion and channel combination of the previous paragraph and vice versa. In many examples, only one combination of protrusion and channel would need to be present on the ice-shaping device 100.

Referring to FIG. 14, a cross-section view of the top press portion or cover 102 taken along line 14-14 of FIG. 12 is illustrated. The interior space 1302 defined by the cover inside surface 1300 defines a second ice molding cavity 1400 that cooperates with the first ice molding cavity 1102 (shown in FIG. 11). The cover inside surface 1300 can be hemispherical as shown by dimension 1402 to define the second ice molding cavity 1400. The cover inside surface 1300 defines the second ice molding cavity 1400 such that the second ice molding cavity 1400 cooperates with the first ice molding cavity 1102 to form a spherical ice mold when the cover 102 is in the closed position. In other words, when the first ice molding cavity 1102 and the second ice molding cavity 1400 cooperate, the two cavities 1102, 1400 define a sphere or spherical shape.

FIG. 14 also illustrates a generally spherical (as represented by dimension 1404) handle 1210 constructed as a unitary part of the cover 102. As noted previously, this is not required, and any handle fastened to the cover 102 is satisfactory.

Figure 15:
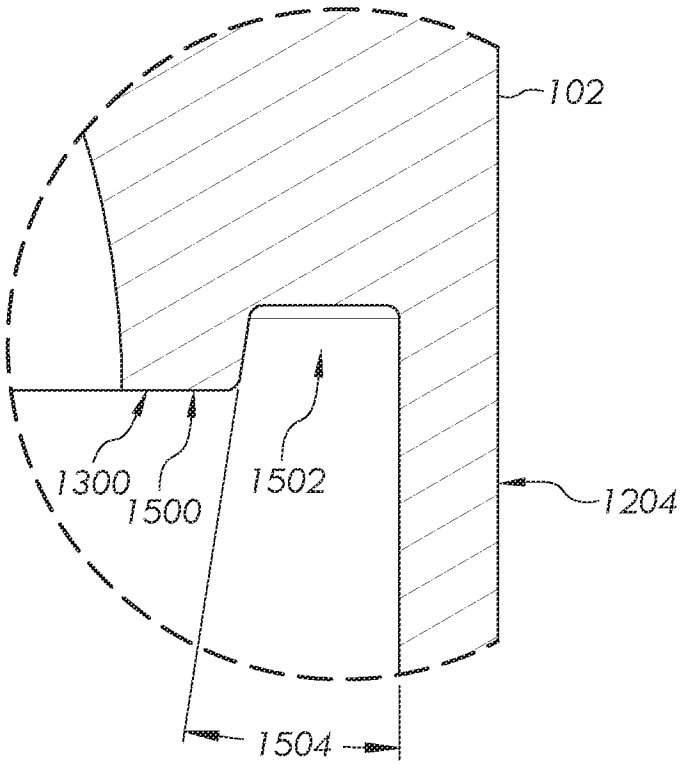
FIG. 15 illustrates a detail view of FIG. 14.

Referring to FIG. 15, a detail view of FIG. 14 is illustrated to show a portion of the cover inside surface 1300. The cover inside surface 1300 can include a ring-like surface 1500 that, in some examples, contacts an upward facing surface in the relief area 812 (shown in FIG. 8) of the bottom press 300 when the cover 102 is in the closed position. The cover inside surface 1300 can also define an undercut 1502 that is configured to enable the first tab 816 and the second tab 818 of the bottom press 300 to be received within the undercut 1502 when the cover 102 is in the closed position. It is to be understood that when the cover 102 is in the open position, the first tab 816 and the second tab 818 of the bottom press 300 to be received within the undercut 1502. Opposing surfaces defining the undercut 1502 can be oriented such that the opposing surfaces are not parallel to one another. For example, as shown in FIG. 15, the opposing surfaces can form an angle 1504. In some examples, the angle 1504 can be about 10 degrees.

Figure 16:
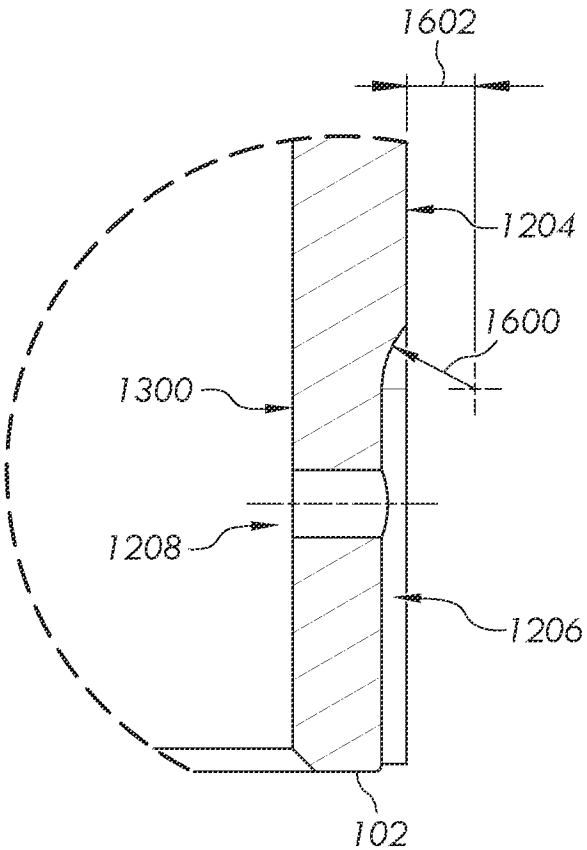
FIG. 16 illustrates a detail view of FIG. 14.

Referring to FIG. 16, another detail view of FIG. 14 is illustrated to show the channel 1206 and the aperture 1208 defined by the cover 102. The channel 1206 is defined by the cover outside surface 1204 and the aperture 1208 can be defined by both the cover outside surface 1204 and the cover inside surface 1300. In some examples, an upper end of the channel 1206 includes a radius as shown by dimension 1600, with a radius center point spaced a distance 1602 from the cover outside surface 1204.

Returning to FIG. 3, as previously discussed, when the cover 102 is in the closed position, the first ice molding cavity 1102 and the second ice molding cavity 1400 cooperate to define a spherical ice mold volume 314 to form the ice 312 into a sphere. Generally, when the cover 102 is in an open position, an operator places a piece of ice into the first ice molding cavity 1102. The piece of ice typically has at least one dimension that is greater than a diameter of the molded ice sphere. When the cover 102 is in the open position, the first base end 304 is not located within the interior space 1302 of the cover 102.

The operator then places the cover 102 over the base 104 such that the first base end 304 begins to enter the interior space 1302 defined by the cover inside surface 1300. As the operator slides the cover 102 in a downward path over the first base end 304, the hemispherical surface of the second ice molding cavity 1400 contacts the ice. The weight of the cover 102, or a significant portion of the weight of the cover 102, impinges upon the ice 312 creating friction and heat that melts a portion of the ice 312 and eventually forms an ice sphere as the cover 102 slides further into the closed position during the ice shaping process.

It is to be appreciated that when in the closed position, the first base end 304 is located within the interior space 1302 of the cover 102 defined by the cover inside surface 1300 and the second ice molding cavity 1400. The second ice molding cavity 1400, as a portion of the ice 312 melts, moves generally downward to cooperate with the first ice molding cavity 1102. This cooperation forms the spherical ice mold volume 314, and the remaining ice 312 is thus formed into a spherical shape.

As previously discussed, as the cover 102 moves or lowers from the open position to the closed position, the protrusion 1002 cooperates with the channel 806 providing a physical interference to inhibit rotation of the cover 102 with respect to the base 104.

The material and mass of the material composing the cover 102 and the base 104 can provide a heat sink for the ice such that heat transfer between the ice 312 and the ice-shaping device 100. The composition materials of both the cover 102 and the base 104 have been discussed. In some examples, the composition material is the same for both the cover 102 and the base 104. However, in some examples, the cover 102 can include a first metal alloy (e.g., copper), and the base 104 can include a second metal alloy (e.g., aluminum). Of course, other combinations of materials are also contemplated.

When the cover 102 is in the closed position, each of the first ice molding cavity 1102 and the second ice molding cavity 1400 are in fluid communication with the relief area 812 of the bottom press 300. As the cover 102 presses downward upon the ice 312, ice melt (e.g., water) can move from the first ice molding cavity 1102 and the second ice molding cavity 1400 through pressure, gravity or any other means and move to the relief area 812. The relief area 812 is in fluid communication with the channel 806 defined by the base outside surface 804. The channel 806 is in fluid communication with the retaining volume 604 defined by the drain base 302.

As such, the second ice molding cavity 1400 cooperates with the first ice molding cavity 1102 such that melted water from at least one of the first ice molding cavity 1102 or the second ice molding cavity 1400 is directed through the relief area 812 to the channel 806, and channel 806 to direct the quantity of melted water from at least one of the first ice molding cavity 1102 or the second ice molding cavity 1400 to the retaining volume 604 to reduce hydrostatic pressure acting between the base 104 and the cover 102.

In some examples, the first tab 816 and the second tab 818 can be received in the undercut 1502 defined by the cover inside surface 1300 of the cover 102. When the cover 102 is in the open position, the first tab 816, the second tab 818, and the relief area 812 are not located within the interior space 1302 defined by the cover inside surface 1300 of the cover 102. When the cover 102 is in the closed position, the first tab 816, the second tab 818, and the relief area 812 are located within the interior space 1302 defined by the cover inside surface 1300 of the cover 102.

The remainder of the disclosure is directed to at least one additional example of an ice-shaping device. Less important details or repeated details regarding the ice-shaping devices may be disregarded in the following sections with the understanding that many of the details of the previously described examples also apply to the following examples.

Figure 17:
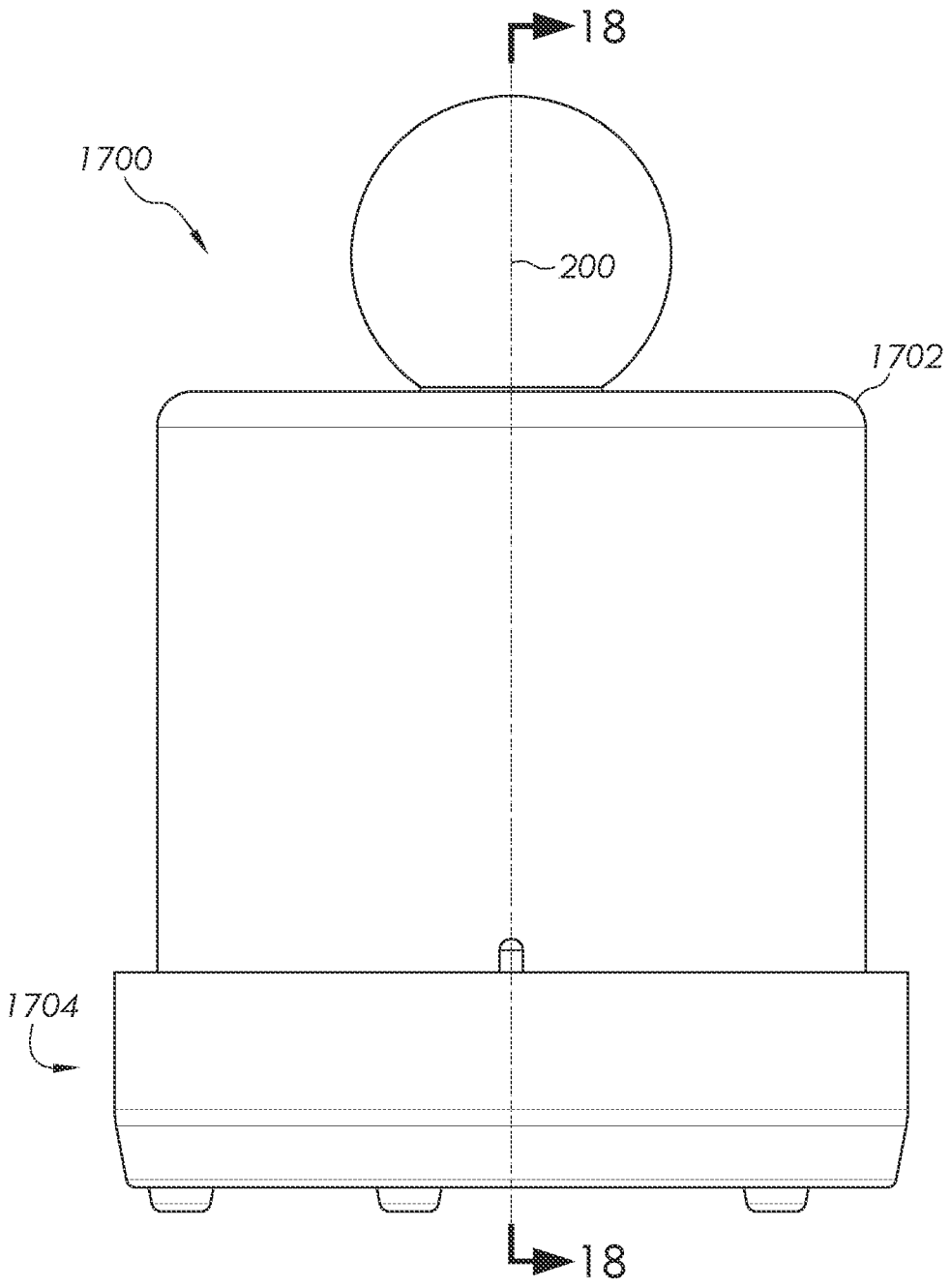
FIG. 17 illustrates an elevation view of an ice-shaping device according to at least one embodiment of the disclosure.

Referring to FIG. 17, an elevation view of an example ice-shaping device 1700 is illustrated. As shown, a cover 1702 and a base 1704 can include some portions that are cylindrical, and these portions can be centered about an axis 200. It is to be appreciated that the exterior dimensions and shapes of the cover 1702 and the base 1704 can be selected for aesthetic benefits or operational benefits as the designer or end user may desire. In some examples, logos, trademarks, or other designs may be placed on the exterior surfaces of the ice-shaping device 1700.

Figure 18:
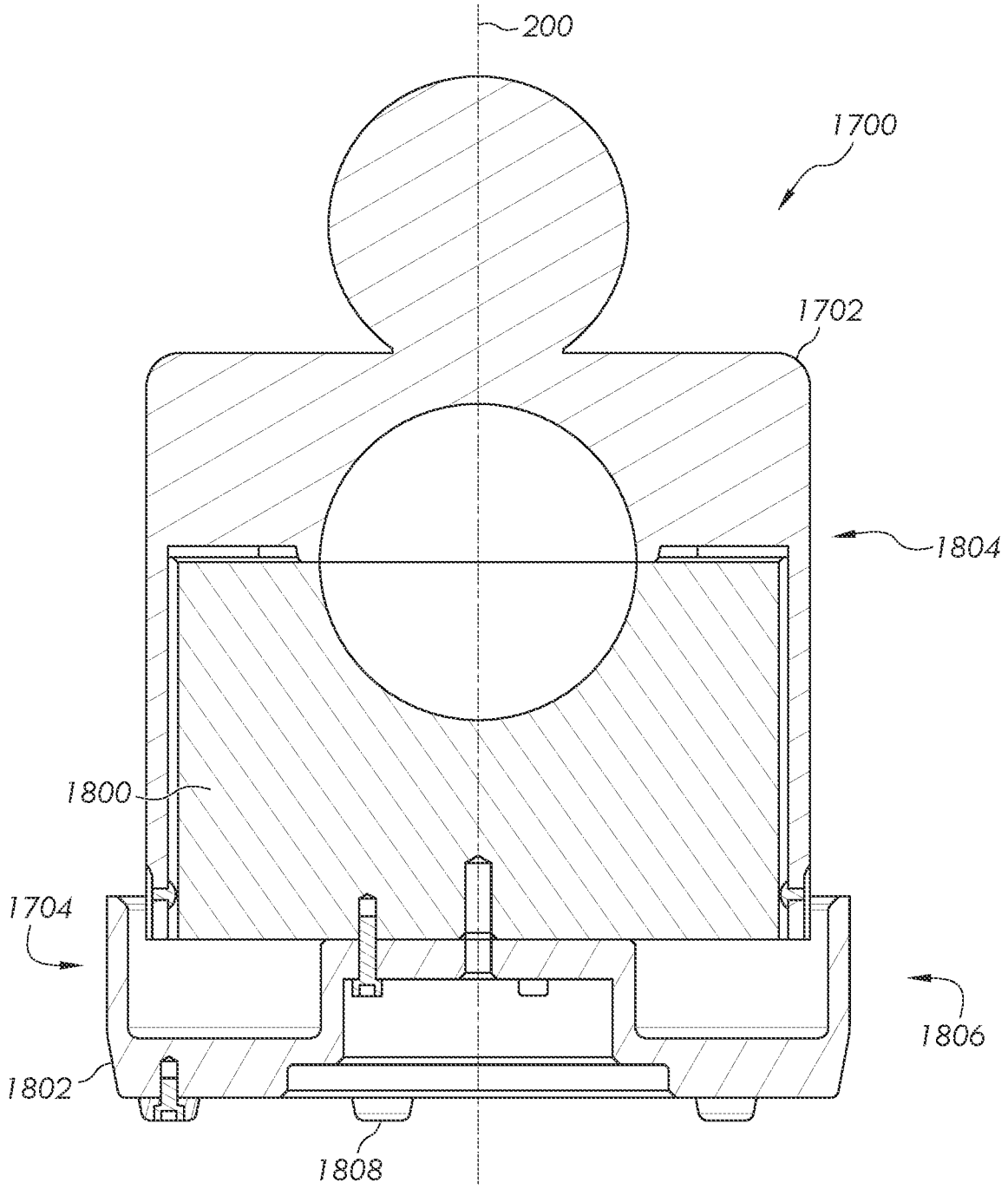
FIG. 18 illustrates a cross-section view of the ice-shaping device taken along line 18-18 of FIG. 17.

Referring to FIG. 18, a cross-section view of the ice-shaping device taken along line 18-18 of FIG. 17 is illustrated. The base 1704 of the example ice-shaping device 1700 includes a bottom press 1800 and a drain base 1802. The bottom press 1800 and the drain base 1802 can be attached to one another by any suitable method or structure including, but not limited to, a threaded fastener, press-fit, welding, etc. It is to be appreciated that the base 1704 can be constructed of a single, unitary piece. In some examples, the base 1704 includes a leg 1808. Any suitable number of legs 1808 can be included.

The base 1704 extends from a first base end 1804 to a second base end 1806. In some examples, the first base end 1804 can be located on the bottom press 1800 while the second base end 1806 is located at or toward the drain base 1802. Other orientations are also contemplated.

Figure 19:
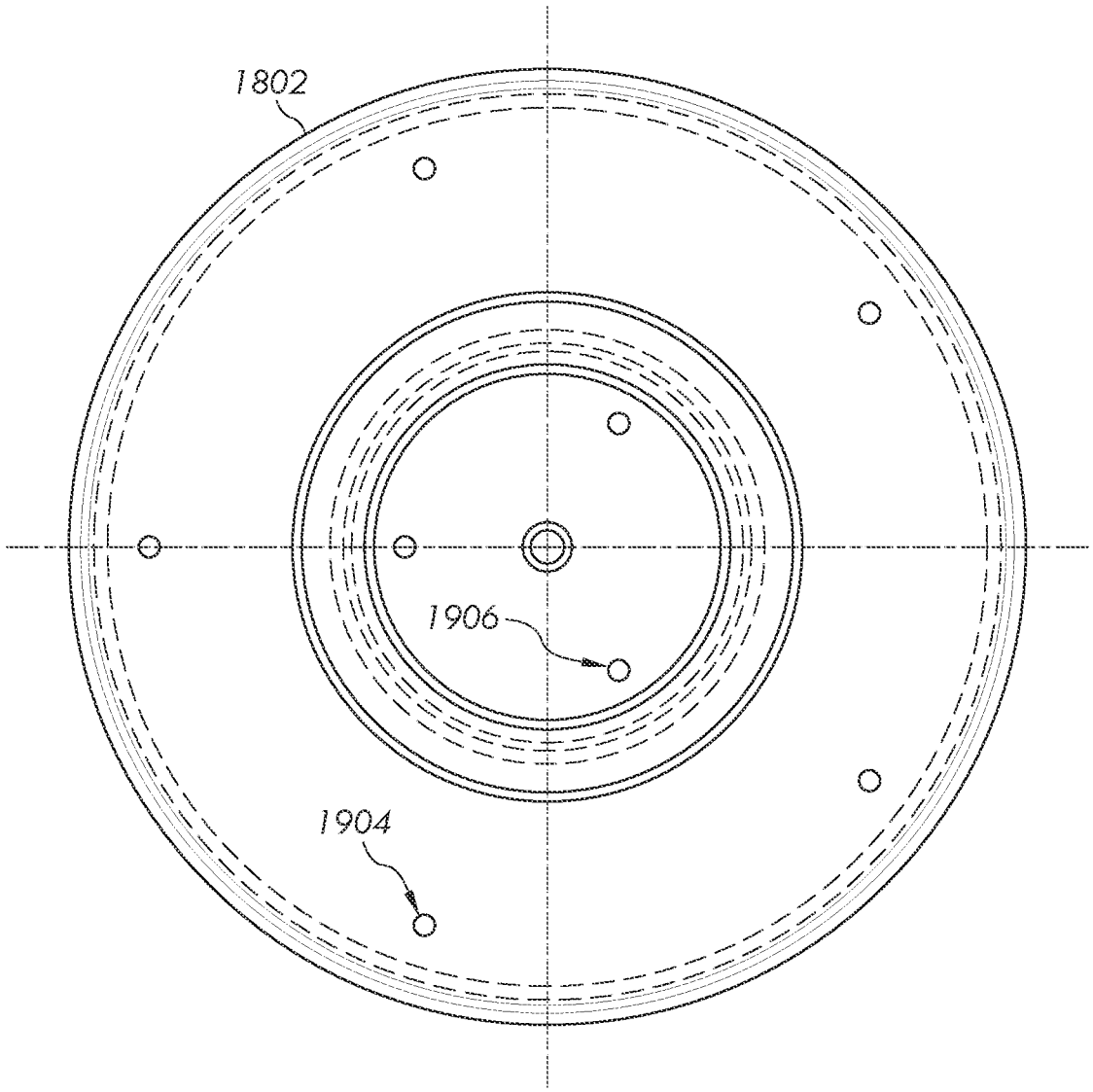
FIG. 19 illustrates a bottom view of a drain base of the ice-shaping device of FIG. 17.

Referring to FIG. 19, a bottom view of the drain base 1802 of the ice-shaping device 1700 is illustrated. In some examples, the drain base 1802 can define blind holes or apertures 1904 to attach the previously described legs 1808 (not shown in FIG. 19). The apertures 1904 can be threaded in order to mount the legs 1808, however, any attachment means or structure is acceptable. The drain base 1802 can also define apertures 1906 that can be used to attach the drain base 1802 to the bottom press 1800 (not shown in FIG. 19), for example, with threaded fasteners.

Figure 20:
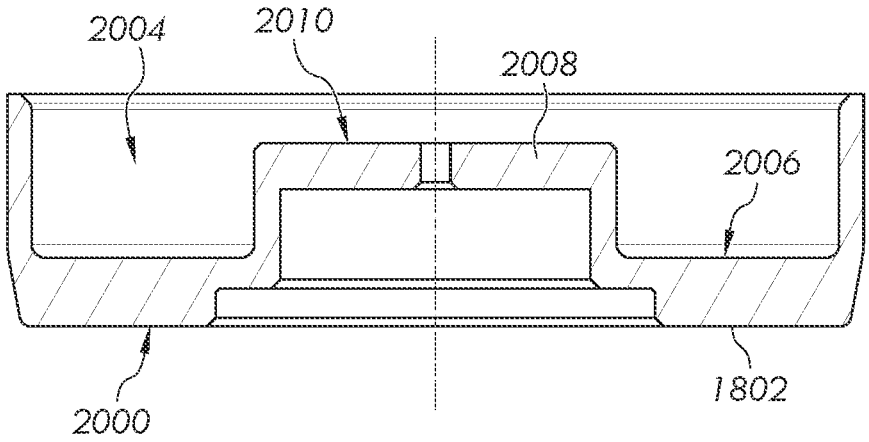
FIG. 20 illustrates a cross-section view of the drain base taken along line 18-18 of FIG. 17.

Referring to FIG. 20, a cross-section view of the drain base 1802 taken along line 18-18 of FIG. 17 is illustrated. The drain base 1802 defines a retaining volume 2004 in order to retain a quantity of melted water from at least one portion of an ice molding cavity that will be described below. As shown, the retaining volume 2004 can be of annular shape, however, any suitable shape or cross-section can be used with the devices of the present disclosure. The retaining volume 2004 can be at least partially defined by a bottom surface 2006 that is separated a distance from the bottom surface 2000 of the drain base 1802.

The drain base 1802 can include a raised table 2008 extending generally away from the bottom surface 2006 of the retaining volume 2004. The raised table 2008 can include an upward facing surface 2010 that cooperates with a surface of the bottom press 1800 (not shown in (FIG. 20) for mounting purposes.

Figure 21:
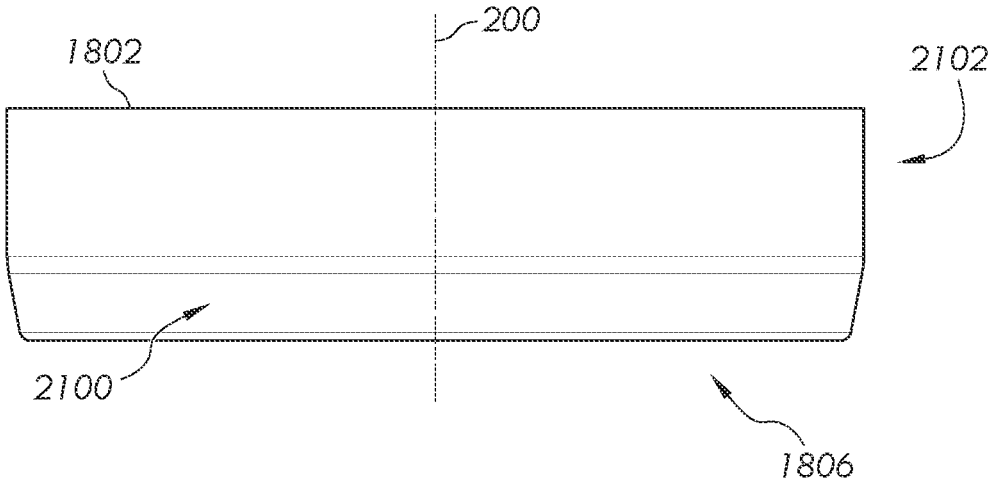
FIG. 21 illustrates an elevation view of the base of the ice-shaping device.

Referring to FIG. 21, an elevation view of the base of the ice-shaping device 1700 is illustrated. In some examples, the drain base 1802 has an outside surface 2102 that is cylindrical in shape, and the generally cylindrical drain base 1802 can be centered about the axis 200. Of course, other exterior shapes, profiles, and cross-sections for the drain base 302 can be used, and the cylindrical shape is not meant to be limiting. As shown, the drain base 1802 can include a taper 2100 at a lower portion of the drain base 1802 for aesthetic purposes, or weight removal purposes, etc. As noted previously, the drain base 1802 can be located at or toward the second base end 1806 of the base 1704.

Figure 22:
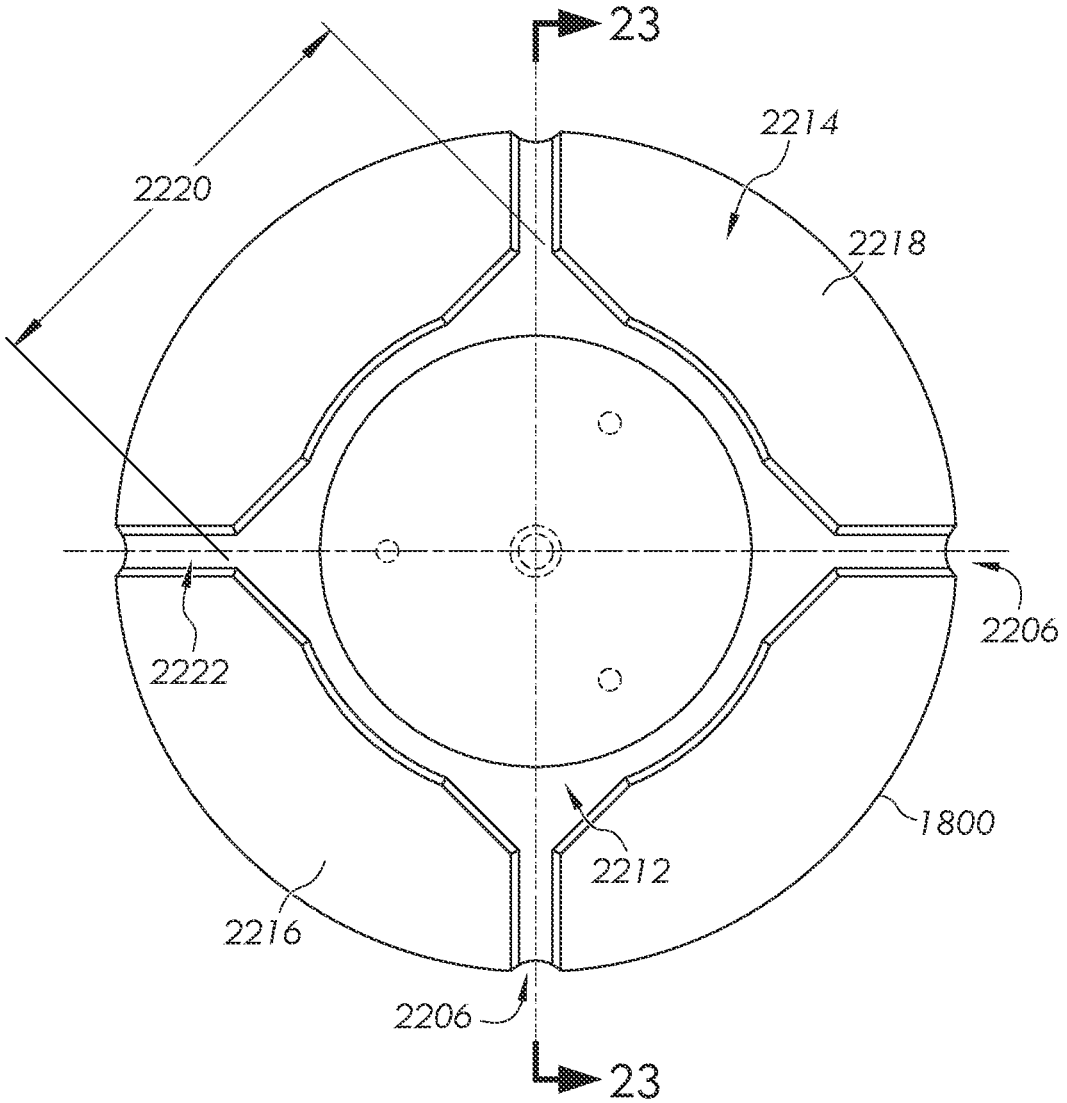
FIG. 22 illustrates a top view of a bottom press portion of the ice-shaping device of FIG. 17.

Referring to FIG. 22, a top view of a bottom press 1800 of the ice-shaping device 1700 is illustrated. An example geometry of a first tab 2216 and a second tab 2218 are shown, however, any suitable geometry is acceptable for use with the present disclosure. Spacing between the tabs 2216, 2218 can be designed and manufactured to optimize the movement of ice melt (water) flow from a relief area 2212 to the channels 2206. Generally, the relief area 2212 can extend downward from a top surface 2214. The relief area 2212 can be formed by removing material (e.g., machining) a circular area at the center of the bottom press 1800, machining a square area noted by dimension 2220, and machining a path 2222 to each channel 2206. Additionally, four channels 2206 are shown, but this is merely an example, and is not meant to be limiting. In some examples, the channel 2206 also provides open space for cooperation with a protrusion (not shown in FIG. 22) located on the cover 1702.

Figure 23:
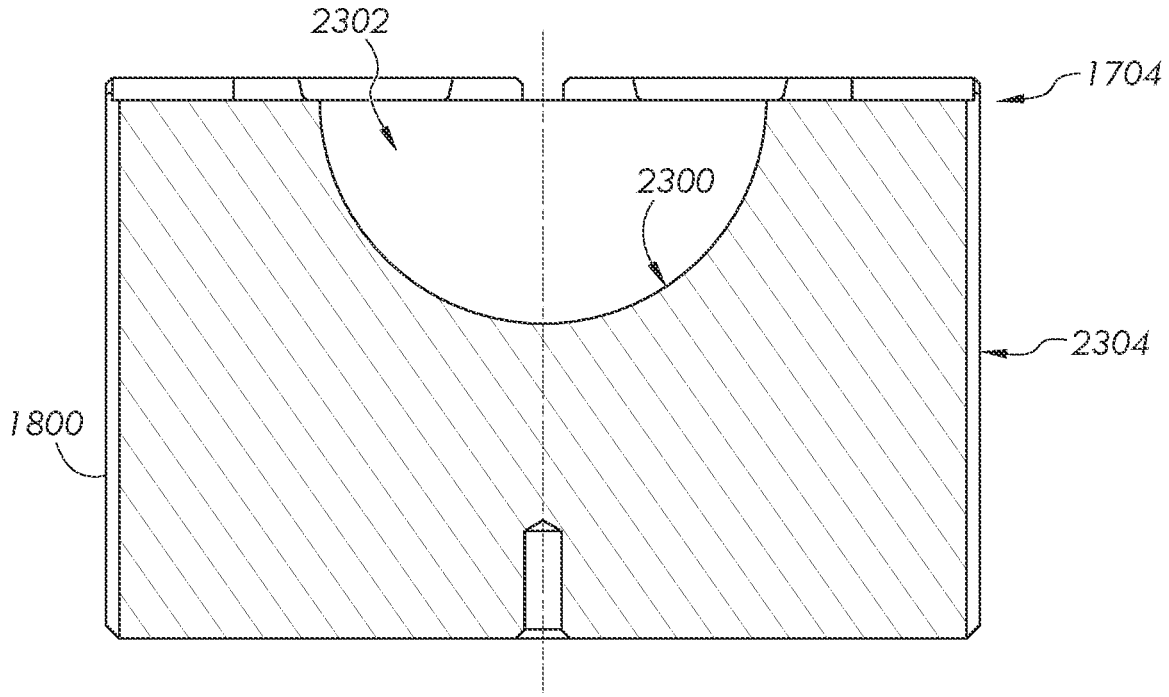
FIG. 23 illustrates a cross-section view of the bottom press portion taken along line 23-23 of FIG. 22.

Referring to FIG. 23, a cross-section view of the bottom press portion taken along line 23-23 of FIG. 22 is illustrated. The bottom press 1800 of the base 1704 also includes a base inside surface 2300 in addition to the base outside surface 2304. The base inside surface 2300 defines a first ice molding cavity 2302 at the first base end 1704. In some examples, the base inside surface 2300 is hemispherical to define the first ice molding cavity 2302. The hemispherical inside surface 2300 is one example of possible shapes or profiles of the base inside surface 2300, and other shapes or profiles are also contemplated.

Figure 24:
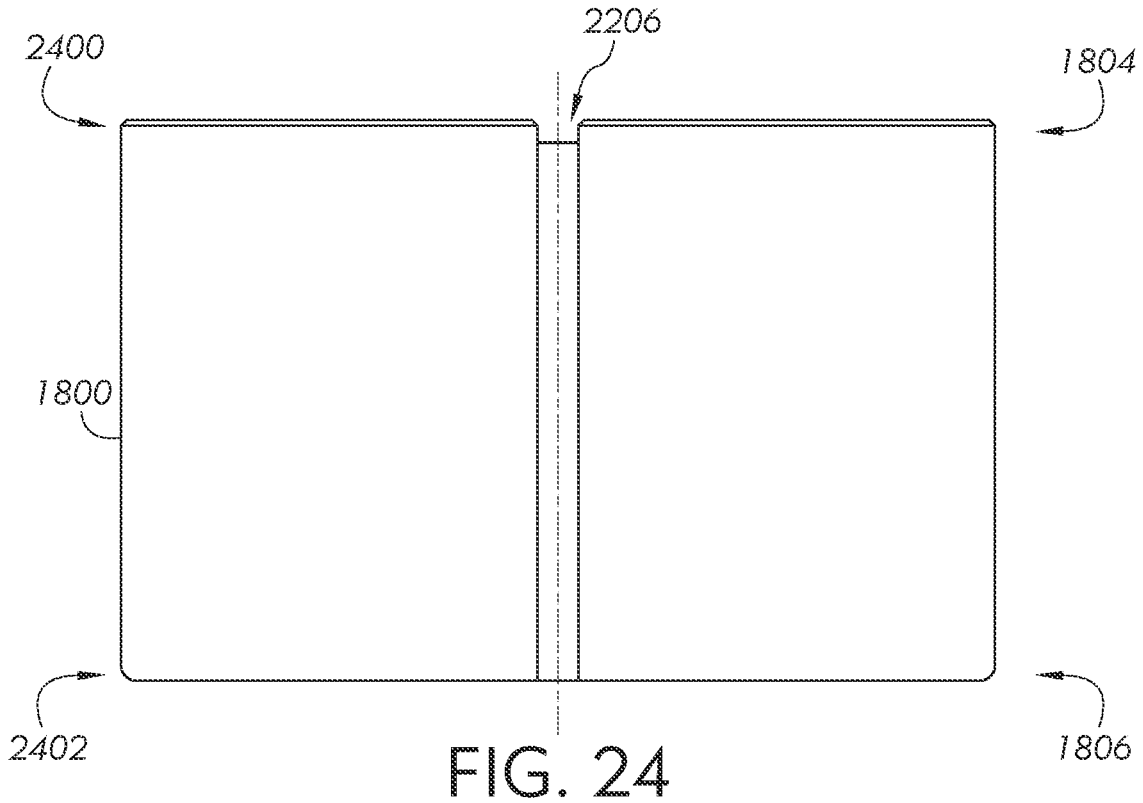
FIG. 24 illustrates an elevation view of the bottom press portion.

Referring to FIG. 24, an elevation view of the bottom press 1800 is illustrated. The bottom press 1800 can extend from an upper end 2400 to a lower end 2402. In some examples, the upper end 2400 and the lower end 2402 can correspond to the first base end 1804 and the second base end 1806, respectively, of the base 1704. In some examples, the bottom press 1800 has the base outside surface 2304 that is cylindrical in shape, and the generally cylindrical bottom press 1800 can be centered about the axis 200. Of course, other exterior shapes, profiles, and cross-sections for the bottom press 1800 can be used, and the cylindrical shape is not meant to be limiting. The base outside surface 2304 defines the channel 2206 that extends away from the first base end 1804 toward the second base end 1806. The channel 2206 can provide a pathway or direct a quantity of melted water from at least one portion of an ice molding cavity 2302 to the retaining volume 2004 defined by the drain base 1802 shown in FIG. 20. Any suitable quantity of channels 2206 can be defined by the bottom press 1800.

Figure 25:
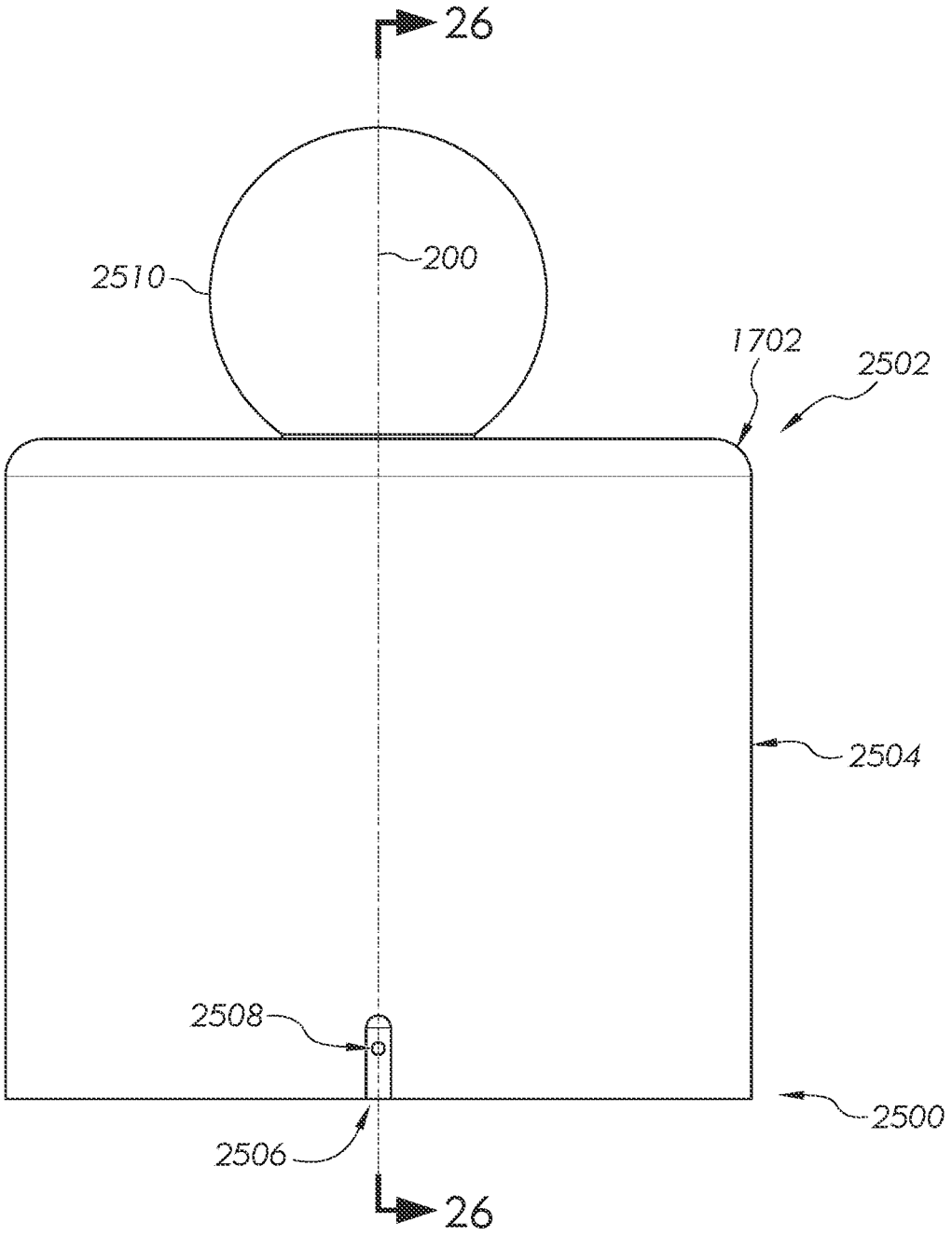
FIG. 25 illustrates an elevation view of a cover or top press portion of the ice-shaping device of FIG. 17.

Referring to FIG. 25, an elevation view of a cover 1702 or top press portion of the ice-shaping device 1700 is illustrated. The cover 1702 extends from a first cover end 2500 to a second cover end 2502. The cover 1702 has a cover outside surface 2504 that can be cylindrical in shape and the cylindrical shape of the cover 1702 can be centered about axis 200. As shown, the cover 1702 can define a slot, groove, or channel 2506 within the outside surface 2504. The cover 1702 can also define an aperture 2508 that aligns with the channel 2506 such that a protrusion can be attached to the cover 1702.

In some examples, the cover 1702 includes a handle 2510 on the cover outside surface 2504 or a top side of the cover 1702. The handle 2510 can be generally spherical, however, any suitable shape of handle 2510 can be used with the devices of the present disclosure.

Figure 26:
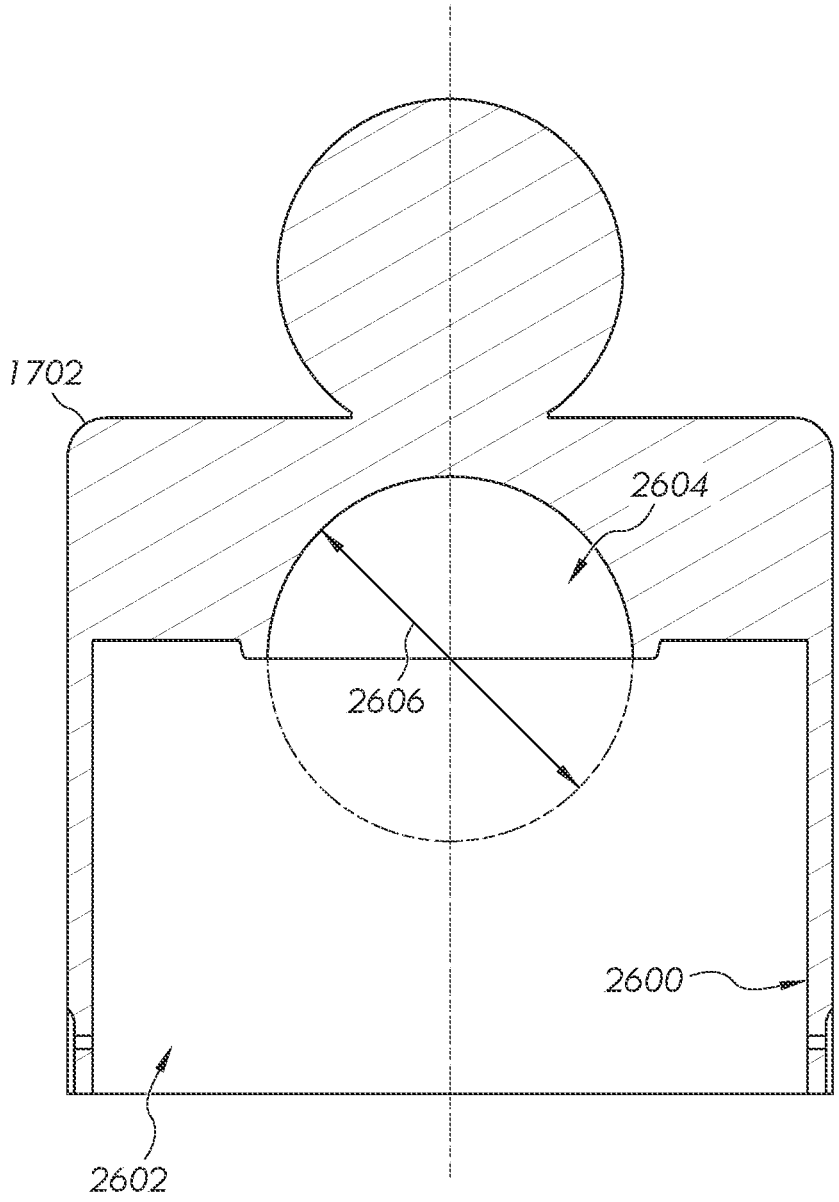
FIG. 26 illustrates a cross-section view of the top press portion taken along line 26-26 of FIG. 25.

Referring to FIG. 26, a cross-section view of the top press or cover 1702 taken along line 26-26 of FIG. 25 is illustrated. An interior space 2602 defined by a cover inside surface 2600 defines a second ice molding cavity 2604 that cooperates with the first ice molding cavity 2302 (shown in FIG. 23). The cover inside surface 2600 can be hemispherical as shown by dimension 2606 to define the second ice molding cavity 2604. The cover inside surface 2600 defines the second ice molding cavity 2604 such that the second ice molding cavity 2604 cooperates with the first ice molding cavity 2302 to form a spherical ice mold when the cover 1702 is in the closed position. In other words, when the first ice molding cavity 2302 and the second ice molding cavity 2604 cooperate, the two cavities 2302, 2604 define a sphere or spherical shape.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first component and a second component correspond to component A and component B or two different or two identical components or the same component.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are to be construed to mean "one or more" unless specified otherwise or clear from context to be directed to a singular form. Also, at least one of A and B or the like means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. An ice-shaping device comprising:

a base extending from a first base end to a second base end, the base having a base inside surface and a base outside surface, the base inside surface defining a first ice molding cavity at the first base end, the base outside surface defining a channel that extends away from the first base end toward the second base end; and a cover extending from a first cover end to a second cover end, the cover having a cover inside surface and a cover outside surface, the cover inside surface defining a second ice molding cavity that cooperates with the first ice molding cavity, the cover comprising a protrusion on the cover inside surface that cooperates with the channel, wherein:

the cover is movable with respect to the base from an open position to a closed position such that a distance by which the cover is separated from the base decreases as the cover is moved from the open position to the closed position, when in the closed position, the first base end is located within an interior space of the cover defined by the cover inside surface and the second ice molding cavity cooperates with the first ice molding cavity, when in the open position, the first base end is not located within the interior space of the cover, and during movement of the cover from the open position to the closed position, the protrusion cooperates with the channel providing a physical interference to inhibit rotation of the cover with respect to the base.

2. The ice-shaping device of claim 1, the base inside surface being hemispherical to define the first ice molding cavity.

3. The ice-shaping device of claim 1, the cover inside surface being hemispherical to define the second ice molding cavity.

4. The ice-shaping device of claim 1, the base defining a retaining volume to retain a quantity of melted water from at least one of the first ice molding cavity or the second ice molding cavity.

5. The ice-shaping device of claim 4, wherein the channel is in fluid communication with the retaining volume and at least one of the first ice molding cavity or the second ice molding cavity to direct the quantity of melted water from at least one of the first ice molding cavity or the second ice molding cavity to the retaining volume.

6. The ice-shaping device of claim 1, the channel extending from the first base end to the second base end.

7. The ice-shaping device of claim 1, the base defining a relief area on a top surface at the first base end, the relief area in fluid communication with the channel and at least one of the first ice molding cavity or the second ice molding cavity to direct melted water from at least one of the first ice molding cavity or the second ice molding cavity to the channel.

8. The ice-shaping device of claim 1, the base comprising:

a central portion extending away from the first base end toward the second base end; and a drain base attached to the central portion at the second base end, the drain base defining a retaining volume to retain a quantity of melted water from at least one of the first ice molding cavity or the second ice molding cavity.

9. The ice-shaping device of claim 1, the base comprising a leg.

10. The ice-shaping device of claim 1, the cover inside surface being cylindrical.

11. The ice-shaping device of claim 1, the base outside surface being cylindrical.

12. The ice-shaping device of claim 1, the cover comprising a handle on the cover outside surface.

13. An ice-shaping device comprising:

a base extending from a first base end to a second base end, the base having a base inside surface and a base outside surface, the base inside surface defining a first ice molding cavity at the first base end, the base comprising a protrusion on the base outside surface; and a cover extending from a first cover end to a second cover end, the cover having a cover inside surface and a cover outside surface, the cover inside surface defining a second ice molding cavity that cooperates with the first ice molding cavity, the cover inside surface defining a channel that cooperates with the protrusion, wherein:

the cover is movable with respect to the base from an open position to a closed position such that a distance by which the cover is separated from the base decreases as the cover is moved from the open position to the closed position, when in the closed position, the first base end is located within an interior space of the cover defined by the cover inside surface and the second ice molding cavity cooperates with the first ice molding cavity, when in the open position, the first base end is not located within the interior space of the cover, and during movement of the cover from the open position to the closed position, the protrusion cooperates with the channel providing a physical interference to inhibit rotation of the cover with respect to the base.

14. The ice-shaping device of claim 13, the cover and the base comprising a metal alloy.

15. The ice-shaping device of claim 13, the cover comprising a first metal alloy, and the base comprising a second metal alloy.

16. The ice-shaping device of claim 15, the first metal alloy comprising a copper alloy, and the second metal alloy comprising an aluminum alloy.

17. An ice-shaping device comprising:

A base extending from a first base end to a second base end, the base having a base inside surface and a base outside surface, the base inside surface defining a first ice molding cavity at the first base end, the base comprising a first tab and a second tab at the first base end with a relief area defined between the first tab and the second tab, wherein a first portion of a surface of the first base end that defines the relief area is at a first elevation that is less than a second elevation of a second portion of the surface of the first base end that defines at least one of the first tab or the second tab; and a cover extending from a first cover end to a second cover end, the cover having a cover inside surface and a cover outside surface, the cover inside surface defining a second ice molding cavity that cooperates with the first ice molding cavity, wherein:

the cover is movable with respect to the base from an open position to a closed position, when in the closed position, the first tab, the second tab, and the relief area are located within an interior space of the cover defined by the cover inside surface and the second ice molding cavity cooperates with the first ice molding cavity such that melted water from at least one of the first ice molding cavity or the second ice molding cavity is directed through the relief area, and when in the open position, the first tab, the second tab, and the relief area are not located within the interior space of the cover.

18. The ice-shaping device of claim 17, wherein the first tab and the second tab are received in an undercut of the cover.

19. The ice-shaping device of claim 17, wherein:

the base outside surface defines a channel, the cover comprises a protrusion on the cover inside surface, and as the cover is moved from the open position to the closed position, the protrusion cooperates with the channel providing a physical interference to inhibit rotation of the cover with respect to the base.

20. The ice-shaping device of claim 17, wherein:

the base comprises a protrusion on the base outside surface, the cover inside surface defines a channel, and as the cover is moved from the open position to the closed position, the protrusion cooperates with the channel providing a physical interference to inhibit rotation of the cover with respect to the base.

* * * * *